US007009510B1

(12) United States Patent
Douglass et al.

(10) Patent No.: US 7,009,510 B1
(45) Date of Patent: Mar. 7, 2006

(54) ENVIRONMENTAL AND SECURITY MONITORING SYSTEM WITH FLEXIBLE ALARM NOTIFICATION AND STATUS CAPABILITY

(75) Inventors: Robert J. Douglass, Boothwyn, PA (US); James E. Fairburn, Minneapolis, MN (US)

(73) Assignee: Phonetics, Inc., Aston, PA (US)

( * ) Notice: Subject to any disclaimer, the term of this patent is extended or adjusted under 35 U.S.C. 154(b) by 34 days.

(21) Appl. No.: 10/222,484

(22) Filed: Aug. 12, 2002

(51) Int. Cl.
*G08B 1/00* (2006.01)

(52) U.S. Cl. ..... 340/531; 340/506; 340/505; 340/517; 340/520; 340/521; 340/3.1; 340/541; 379/39; 379/40; 379/41; 379/42; 379/43; 379/44; 379/51; 709/206

(58) Field of Classification Search ..... 340/531, 340/506, 505, 517, 520, 521, 3.1, 541; 379/39–44, 379/51; 709/206
See application file for complete search history.

(56) References Cited

U.S. PATENT DOCUMENTS

| | | | | |
|---|---|---|---|---|
| 4,558,181 | A | 12/1985 | Blanchard et al. | |
| 4,688,183 | A | 8/1987 | Carll et al. | |
| 5,061,916 | A | 10/1991 | French et al. | |
| 5,745,268 | A | 4/1998 | Eastvold et al. | |
| 5,892,442 | A | 4/1999 | Ozery | |
| 5,943,394 | A * | 8/1999 | Ader et al. | 379/40 |
| 6,078,649 | A * | 6/2000 | Small et al. | 379/39 |
| 6,215,404 | B1 * | 4/2001 | Morales | 340/577 |
| 6,259,956 | B1 | 7/2001 | Myers et al. | |
| 6,281,790 | B1 | 8/2001 | Kimmel et al. | |
| 6,304,797 | B1 | 10/2001 | Shusterman | |
| 6,362,747 | B1 * | 3/2002 | Parker | 340/691.6 |
| 6,389,464 | B1 * | 5/2002 | Krishnamurthy et al. | 709/220 |
| 6,643,355 | B1 * | 11/2003 | Tsumpes | 379/45 |
| 6,661,340 | B1 * | 12/2003 | Saylor et al. | 340/517 |
| 6,703,930 | B1 * | 3/2004 | Skinner | 340/539.11 |

(Continued)

FOREIGN PATENT DOCUMENTS

JP 405092458 A * 4/1993

OTHER PUBLICATIONS

*NETBOTZ Environment and Equipment Monitoring Appliances*, "Monitoring Appliances".

(Continued)

*Primary Examiner*—Daryl C. Pope
(74) *Attorney, Agent, or Firm*—Fay, Sharpe, Fagan, Minnich & McKee, LLP

(57) ABSTRACT

A monitoring system includes a host having a plurality of sensor inputs for connection to sensors. A converter is designed to receive input signals from the sensor input and to convert the input signals from the sensors into digital signals. A processing system is configured to receive the digital signals and to generate alarm signals in response to selected ones of the received digital signals. An internally integrated voice/data modem is in operative association with the processing system. A phone connector is placed in operative association with the voice/data modem, to act as a port for transmission of the alarms to an external telephone network. A network connector is in operative association with the processing system and is designed to receive data in the form of alarms from the processing system and to act as a port for transmission of the alarm data to data network. The alarms are deliverable over phone lines as voice alarms, pager alarms and fax alarms, and are deliverable over a public or private network as e-mail alarms, SNMP trap alarms, and web page alarms. Remote status inquiries may be made via voice call and two-way e-mail operations.

16 Claims, 14 Drawing Sheets

U.S. PATENT DOCUMENTS

| | | | | |
|---|---|---|---|---|
| 6,714,977 | B1 | 3/2004 | Fowler et al. | |
| 6,727,813 | B1 * | 4/2004 | Iwasaki et al. | 340/531 |
| 6,731,207 | B1 * | 5/2004 | Swieboda et al. | 340/501 |
| 6,807,463 | B1 * | 10/2004 | Cunningham et al. | 700/304 |
| 2001/0039561 | A1 * | 11/2001 | Cho | 709/200 |
| 2002/0035551 | A1 * | 3/2002 | Sherwin et al. | 705/412 |
| 2002/0124081 | A1 | 9/2002 | Primm et al. | |
| 2002/0161885 | A1 | 10/2002 | Childers et al. | |
| 2002/0174223 | A1 | 11/2002 | Childers et al. | |
| 2003/0208480 | A1 | 11/2003 | Faulkner et al. | |
| 2004/0160897 | A1 | 8/2004 | Fowler et al. | |
| 2004/0163102 | A1 | 8/2004 | Fowler et al. | |

OTHER PUBLICATIONS

NetBotz—Intelligent Monitoring of Critical Assets.

* cited by examiner

ENVIRONMENTAL AND SECURITY MONITORING SYSTEM WITH FLEXIBLE ALARM NOTIFICATION AND STATUS CAPABILITY

This invention is directed to the art of monitoring, and more particularly to monitoring devices which provide flexible alarm notification and status information related to environmental and security conditions.

INCORPORATION BY REFERENCE

A patent to Kimmell, U.S. Pat. No. 6,281,790 teaches the use of wireless LAN, the Internet, or other Ethernet network to connect remote sensors to a monitoring site for the purpose of intrusion/fire detection. Disclosed is the use of a Host computer which can divert information to a User via a cellular telephone network and/or paging service in real time.

U.S. Pat. No. 6,259,956 to Myers et al. is directed to a remote monitoring system for an unattended robot liquid storage and dispensing site. Provided is a means which automatically monitors and manages fluid dispensing transactions at remote fluid storage and dispensing sites via the Internet. Also disclosed is the use of LAN, e-mail, or fax to notify personnel at remote site of equipment failures.

U.S. Pat. No. 5,892,442 to Ozery describes a reporting alarm system which utilizes a two-way paging device to communicate between a centralizing sensor station and a security monitoring center.

Eastvold, U.S. Pat. No. 5,745,268, teaches using e-mail to notify remote service personnel of the need for service of any of a plurality of electrical devices connected to a local monitoring system.

French, U.S. Pat. No. 5,061,916, discloses a system and method which reports alarms or other conditions of a building automation system to a remote location. The system collects data, assembles it into a graphic display, and then initiates a facsimile transmission of the graphic display to a remote location.

U.S. Pat. No. 4,558,181 to Blanchard et al., is directed to a portable device for monitoring a local area. A self contained device monitors a selected local area for occurrence of any one of a plurality of preselected conditions. The device includes a connector, connecting the device to local, standard telephone lines, a sound synthesizers, a successive dialing system for dialing successively a repeatable series of preselected telephone numbers in response to an occurrence of one of monitored conditions. The sound synthesizer will place a sound voice message on the telephone lines whereby the termination is responsive to a call back from the device. This patent together with U.S. Pat. Nos. 6,281,790; 6,259,956; 5,892,442; 5,745,268; and 5,061,916 are incorporated by reference herein as background information to illustrate the type of devices and systems to which the present invention is directed.

BACKGROUND OF THE INVENTION

From the patents described above, it is apparent efforts have been made to describe security and/or environmental monitoring systems which send and receive data in a variety of formats including e-mail, faxes, and phone messaging. However, these systems require extensive, inflexible, and complicated setup procedures. The references do not appear to provide for an integrated modem/voice interface and data network interface, which permits reporting of alarm information by voice, pager and fax, and also by e-mail and SNMP over a TCP/IP computer network. Existing devices also do not permit status reports via a voice call and/or two-way e-mail. Also not provided in existing systems is a computer monitoring and interface program which permits for simple interface between the user and device.

SUMMARY OF THE INVENTION

A monitoring system includes a host having a plurality of sensor inputs for connection to sensors. A converter is designed to receive input signals from the sensor input and to convert the input signals from the sensors into digital signals. A processing system is configured to receive the digital signals and to generate alarm signals in response to selected ones of the received digital signals. An internally integrated voice/data modem is in operative association with the processing system. A phone connector is placed in operative association with the voice/data modem, to act as a port for transmission of the alarms to an external telephone network. A network connector is in operative association with the processing system and is designed to receive data in the form of alarms from the processing system and to act as a port for transmission of the alarm data to data network. The alarms are deliverable over phone lines as voice alarms, pager alarms and fax alarms, and are deliverable over a public or private network as e-mail alarms, SNMP trap alarms, and web page alarms. Remote status inquiries may be made via voice call and two-way e-mail operations.

PREFERRED EMBODIMENT

The definitions listed below are provided to assist in understanding the following discussion.

DNS Server: The DNS server is used to translate site names into actual numeric network addresses Enable Microphone Listen-In: Enabling this feature allows users to listen through a microphone on the front panel of the unit when dialing the unit in Voice mode. Disabling this feature prevents the microphone from being accessed during a telephone call.

Enterprise Name: An Enterprise name appears at the top level of a Host's software screen whenever a user logs on to the Host. It provides identification consistency among multiple users and allows for future Enterprise features.

Enable RAS Command: Setting this to "Y" will enable a Remote Network Access during a dial-up connection.

Enable 2-Way E-mail Command: Setting this to "Y" will enable the 2-way e-mail feature. With this feature enabled the User can send commands to the Host via e-mail and receive responses back. Set this to "N" to disable this feature.

Enable Web Command: Setting this to "Y" will enable the web page feature of the Host. This is set to "N" if you do not want the unit to produce a web page.

Enable Web Password Command: Setting this to "Y" requires a valid user-name and password to be entered in order to view the web page.

Gateway (Default Gateway): A TCP/IP network must have a gateway to communicate beyond the LAN identified by the network ID. A gateway is a computer or router that is connected to two different networks and can move TCP/IP data from one to the other. If a TCP/IP network has more than one LAN or if a connection is being made to the Internet, you will need to know the IP address of the gateway that will transfer TCP/IP data in and out of your LAN. A single LAN that is not connected to other LANs does not require a gateway setting.

Mask: This is the subnet mask which distinguishes the portion of the IP address that is the network ID from the portion that is the station ID.

Node IP Address: This is the IP address assigned to the Host on the network. This address is provided by the user or the network administrator. It is formatted as a standard dotted decimal number.

Node Name: This name will appear in the Host's software display. In systems with many Nodes, the Name is useful for identifying one node from another.

Parent Host IP Address: This is the IP address of the Host that a Node is associated with.

Password: This is the password which protects access to the local configuration parameters. The default password in a new unit is "ims4k".

RAS IP: This is the IP address assigned to the remote computer calling in to the Host.

Subnet Mask: This is the subnet mask which distinguishes the portion of the IP address that is the network ID from the portion that is the station ID.

Figure 1:
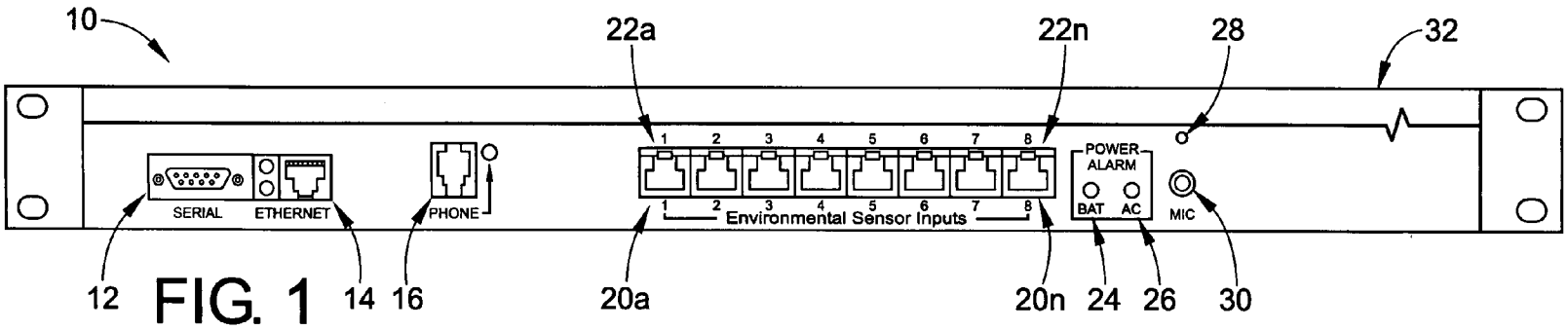
FIG. 1 depicts a front plan view of a Host device according to the concepts of the present application.

Referring now to the drawings wherein the showings are for the purpose of illustrating a preferred embodiment of the invention only and not for the purpose of limiting same, FIG. 1 depicts a portable, self contained monitoring device (also referred to as a Host) 10 constructed in accordance with an embodiment of the present application.

Host 10 includes an input port 12, such as DB9 serial port, through which data is transmitted for initial Host setup. A network port 14, such as an Ethernet port, connects Host 10 to a network such as a local area network (LAN) or wide area network (WAN). A Telephone jack 16 connects the Host to a telephone network such as a public data network, or cellular phone type network. Environmental sensor input connectors 20*a*–20*n* are designed as a plurality of input connectors which support sensors of Host 10, and in one embodiment are RJ45 type connectors. LEDs 22*a*–22*n* are associated with each of the sensor input connectors to show real-time alarm status of the environmental inputs.

Battery alarm indicator 24 provides the status of an internal battery backup system, and an AC power alarm 26 provides the status of an AC power line into which the Host unit 10 is connected. This AC input is received through an AC connector such as one located on the back of Host unit 10 (not shown). An internal microphone 28 gives the unit the capability of performing sound level alarming and remote listening for sensor information. A microphone input jack 30 attaches a remote microphone (not shown) for sound level alarming and remote listening. Battery backup 32 of Host 10 supplies several hours of power if the utility power source has been interrupted. As previously mentioned, the status of battery backup 32 is relayed via battery alarm indicator 24.

Figure 2:
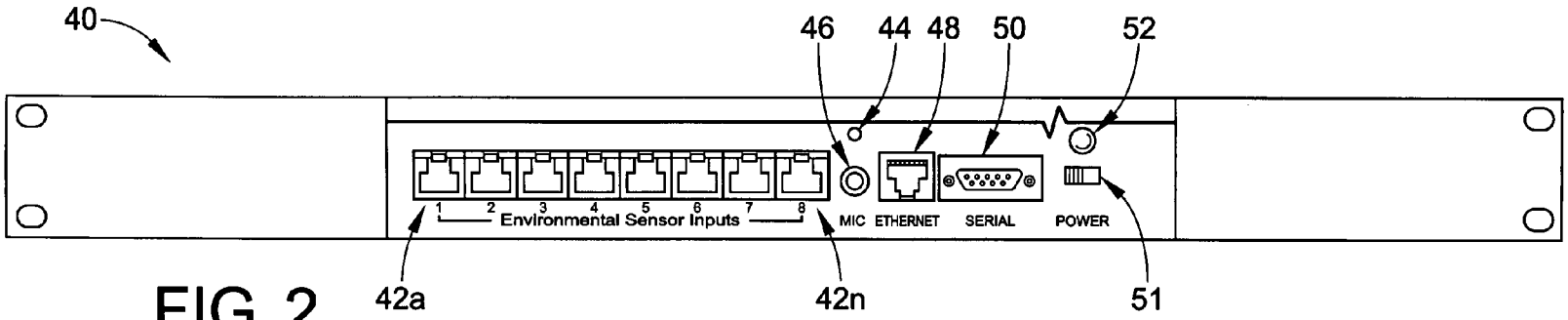
FIG. 2 is a block diagram of a node device used in association with the Host device.

Turning to FIG. 2, illustrated is a Node 40 which includes additional environmental sensor input connectors 42*a*–42*n*, which in one embodiment are RJ45 connectors. A built-in microphone 44 and external microphone jack 46 of Node 40 are used to detect sound level alarms similar to that as shown in connection with Host 10. Node 40 also includes an Ethernet port connection 48 as well as a serial port connection 50 similar to Host 10. A power on/off switch 51 and associated LED power indicator lamp (such as an LED) 52 gives a User the capability to easily verify Node 40 is being supplied with sufficient power.

Figure 3:
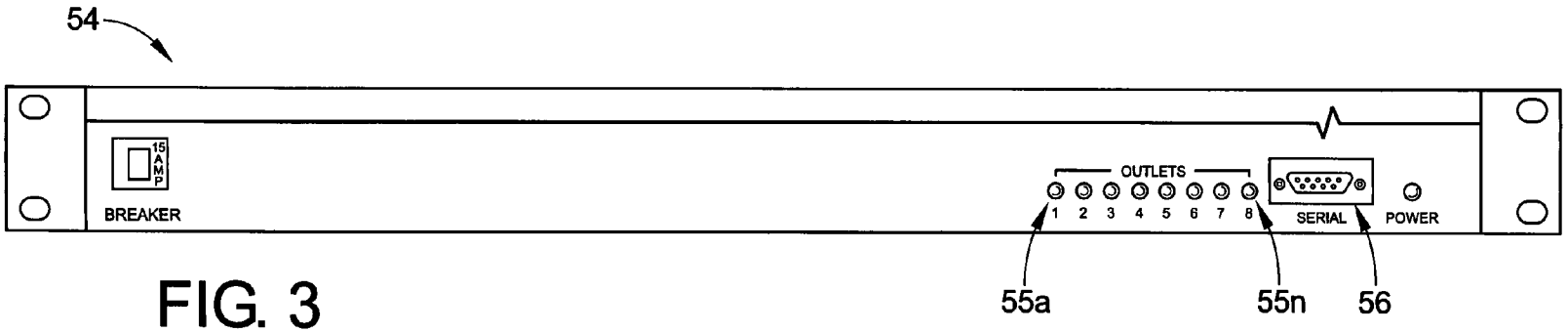
FIG. 3 depicts a power providing/monitoring device.

FIG. 3 depicts a power control unit 54 having a plurality of power inlets 55*a*–55*n*. The power control unit (sometimes called PowerGate) 54 remotely controls power supplied to other networking equipment and includes a serial cable 56, such as a DB9 serial port. Through interconnection of the Host and/or Node and power control unit 54, remote rebooting of critical equipment via e-mail, touchtone phone, or through events which occur in the network is possible.

Figure 4:
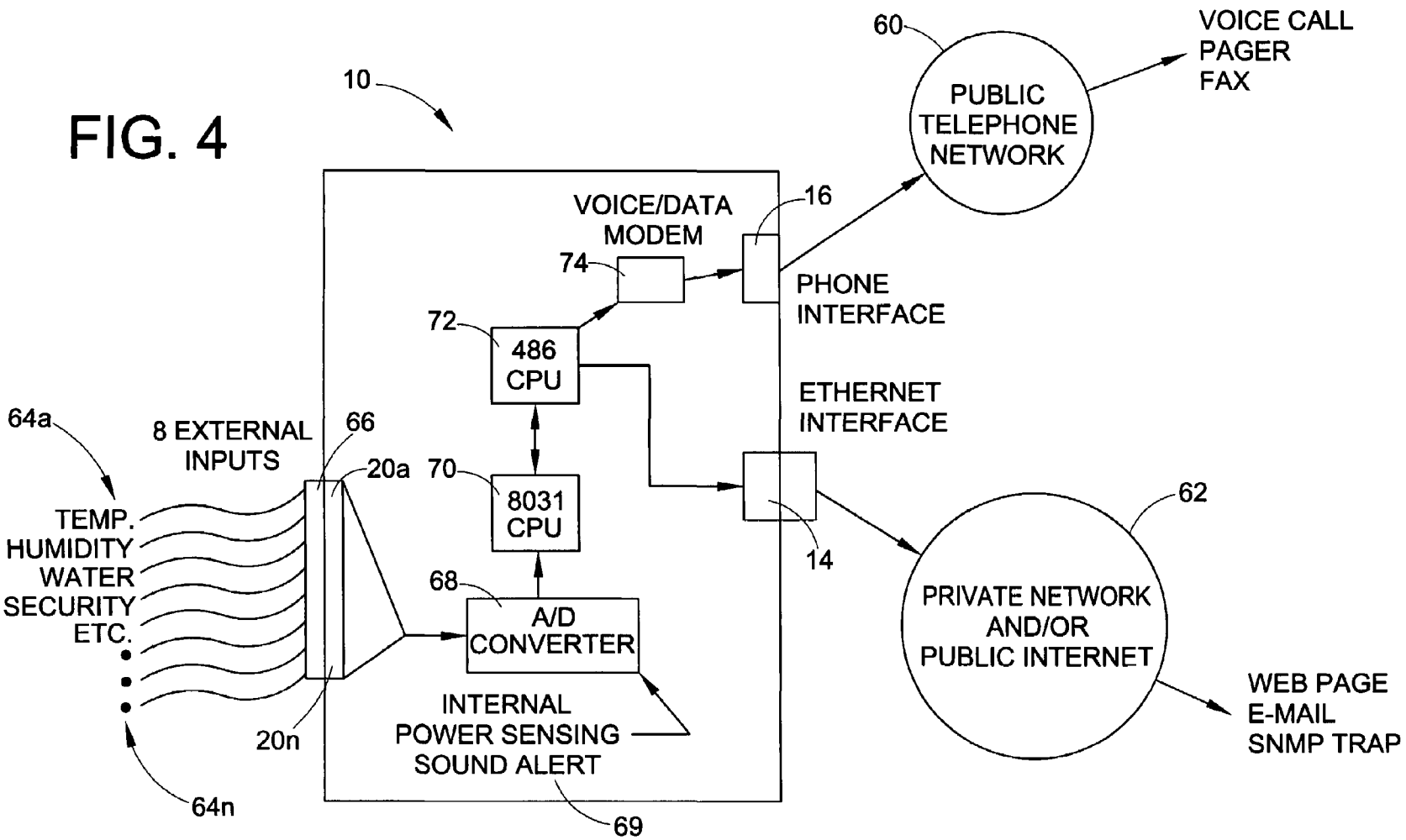
FIG. 4 sets forth a block diagram depicting the Host device.

FIG. 4, is a diagram of an embodiment of Host 10 with connectivity to public telephone network 60 and a private network and/or public Internet 62. As can be seen, a plurality of external sensors 64*a*–64*n* connect to an external input connector 66, such as a ribbon connector or other appropriate connector, which is in-turn connected to internal connectors 20*a*–20*n*. Data signals from this interface are passed to an A-D converter 68, which also receives data signals from internal sensors 69 designed to detect power failure, sound levels, internal temperature, humidity, air flow and battery backup levels, among others. The data signals received by the A-D converter 68 are then scanned by a processor 70, such as a 8031 microprocessor, or other appropriate processing device. The current value and present status for each of the external and internal sensors are transmitted in an ongoing manner to processor 70 which transmits the signals to a second processor 72, which is '486 microprocessor or other appropriate processing device.

When a sensor data signal is beyond its programmed range, an alert is generated and a notification process is undertaken. Particularly, processor 72 issues alarm signals to at least one of an internal Voice/Data modem and/or network connection 14. The Voice/Data modem configures the data signals for transmission to the public telephone network 60, via internal phone interface 16, as a voice call message, pager message and/or fax message. Additionally or in the alternative, the data from processor 72 is transmitted via network connection 14 to the private network and/or Internet network 62. The data sent to the private network and/or Internet may be sent via a web page, e-mail, SNMP trap, voice over Internet (VoIP) calls, or other appropriate data format.

It is to be appreciated from the discussion related to FIGS. 1–4, the specifically recited connectors, ports, processors and other elements and their arrangements are examples of one embodiment of the Host 10. It is to be appreciated that other arrangements may also be used which will fall within the concepts of the present application. For example, in FIG. 4 whereas multiple processors are used, a single processor unit may also be implemented.

Figure 5:
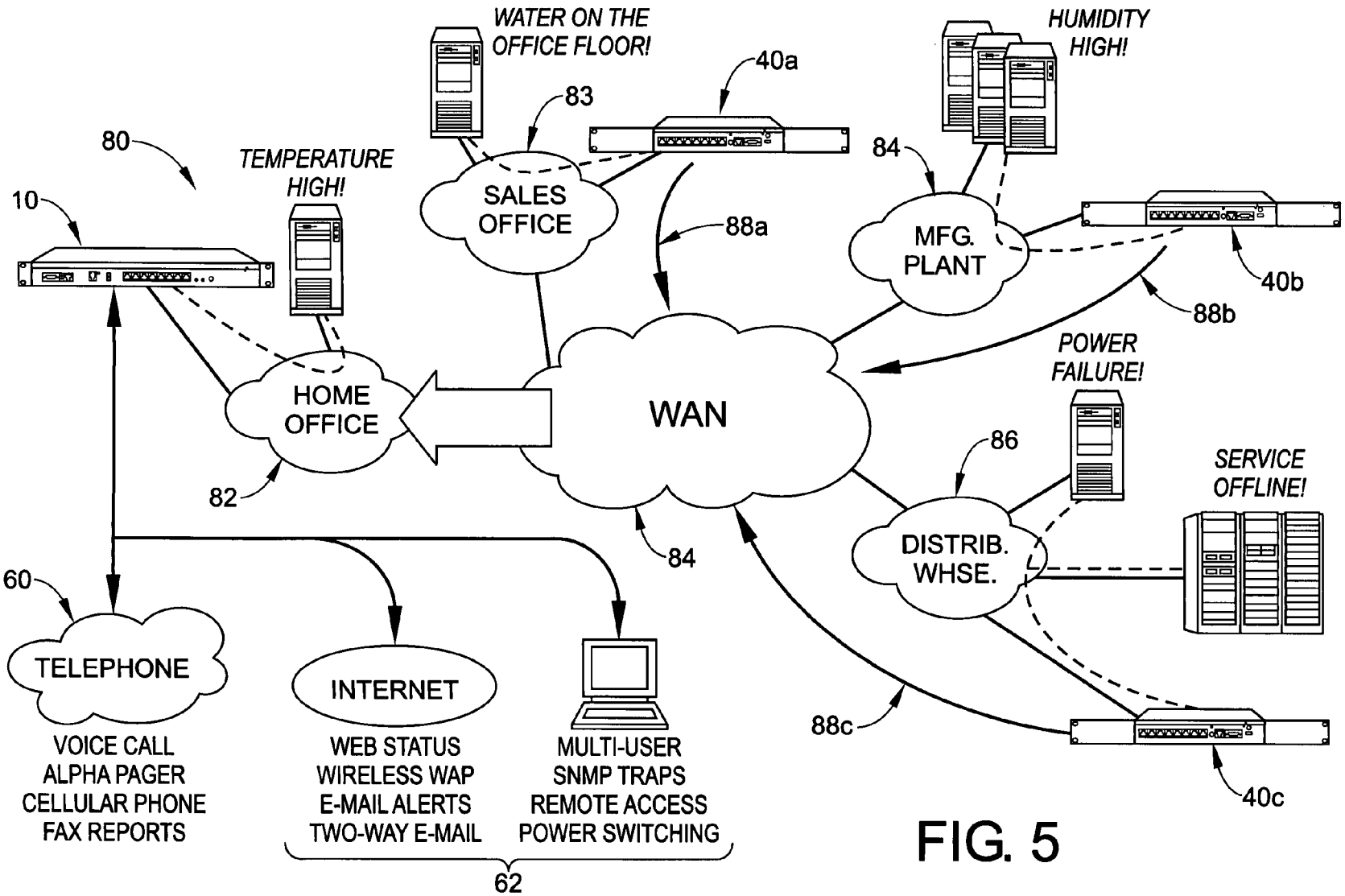
FIG. 5 sets forth a local and enterprise-wide exemplary system where a Host and Nodes monitor a variety of functions.

FIG. 5 is an enterprise-wide monitoring system 80 which incorporates the Host 10, and a plurality of Nodes 40*a*, 40*b*, 40*c*, where the interconnection between Host 10 and the external telephone network 60 and the connection to the private network and/or public Internet 62 is depicted. Nodes

40*a*, 40*b* and 40*c* are connected to different areas of a business, home or other location. In this design, Host 10 is in communication with a home office location 82 which through a wide area network (WAN) 84 further interconnects with Nodes 40*a*, 40*b*, and 40*c*. Node 40*a* is located at a sales office 83 and is interconnected within the sales office systems such as to monitor environmental conditions. Node 40*b* is connected to a manufacturing plant 84, and Node 40*c* to a distribution warehouse 86. While the individual nodes are connected to the computer system or operating system of a specific location, they also have access to the WAN via connections 88*a*, 88*b* and 88*c*.

FIG. 5 emphasizes the expandability of the present system controlled by Host 10. System 80 provides a stand-alone infrastructure monitoring system which includes an integrated voice/data modem, an internal UPS flash-disk storage, and web server, in a flexible, simple to configure design.

A software control program of the present application is designed as a user-friendly interface giving a User the ability to customize system operation. In one embodiment, the control program is embodied as a Windows type interface, although it is understood other formats may also be used. The program permits a User to configure the system, review historical events, determine the status of all monitored network devices, and create and maintain alarms schedules, among numerous other functions, and the is a multi-User network-based application. By this arrangement, whether access is made to the system from a LAN or via a remote dial-in access port, the User has the same visual layout. Through the embedded web server, it is possible to easily obtain status information, historical data, etc., through a web browser or via a web-enabled wireless device.

Figure 6A:
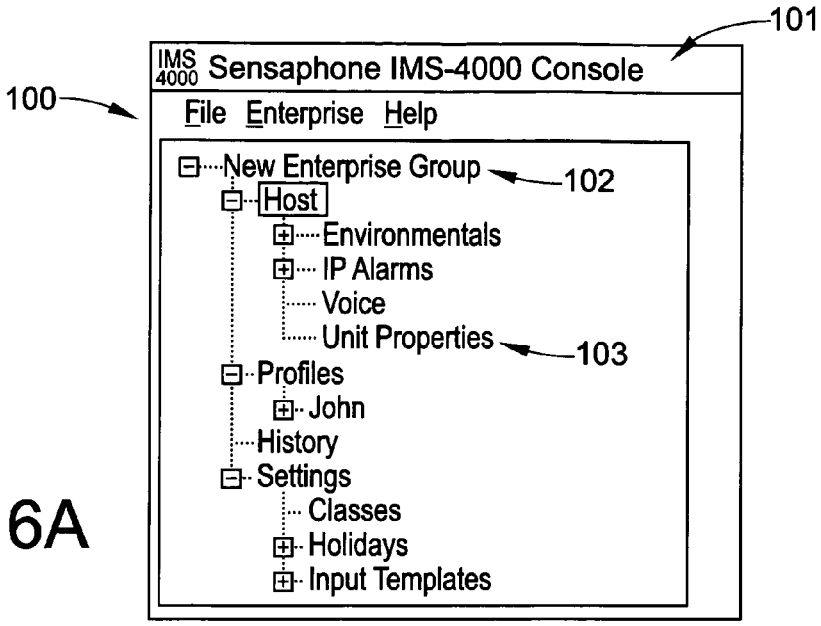
FIGS. 6A–6S are a series of screen displays illustrating operation of the present invention.
Figure 6B:
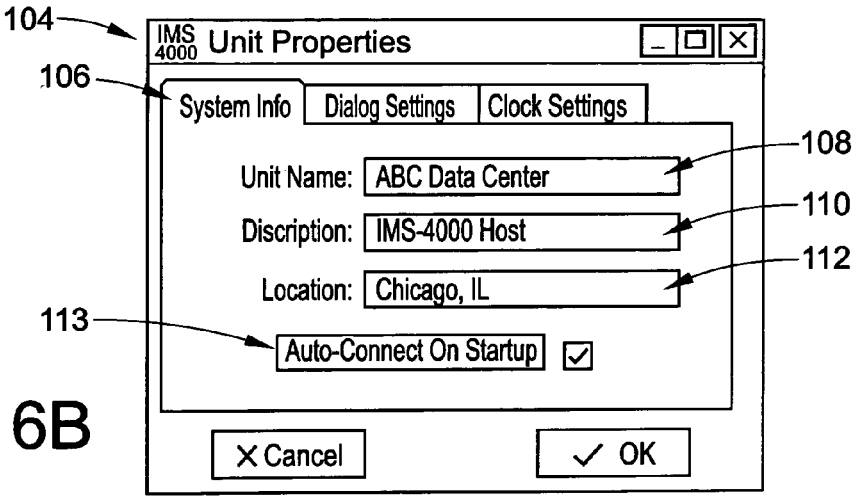
Figure 6C:
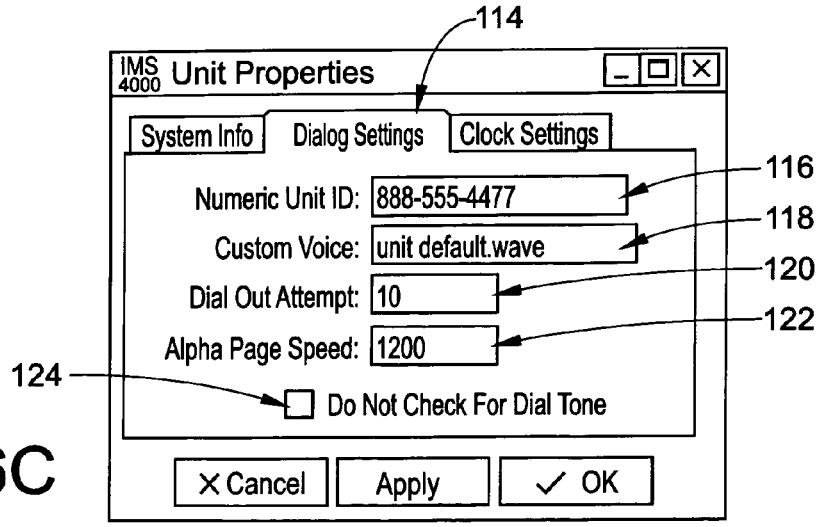
Figure 6D:
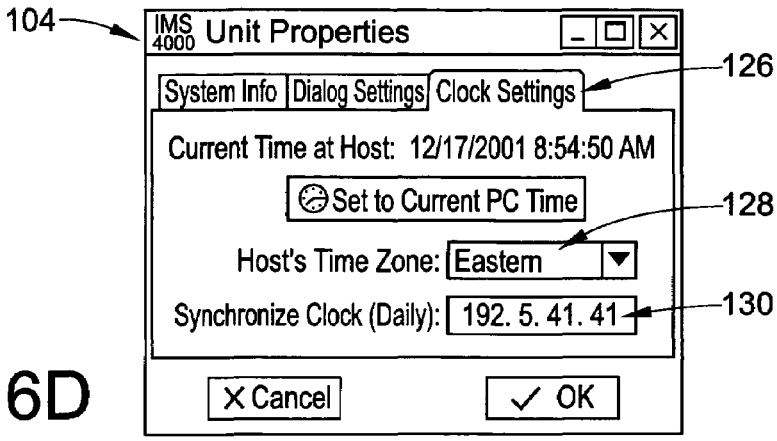
Figure 6E:
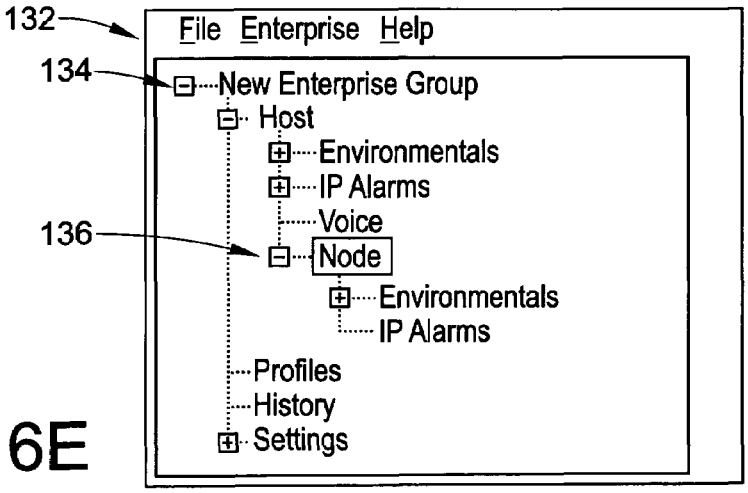
Figure 6F:
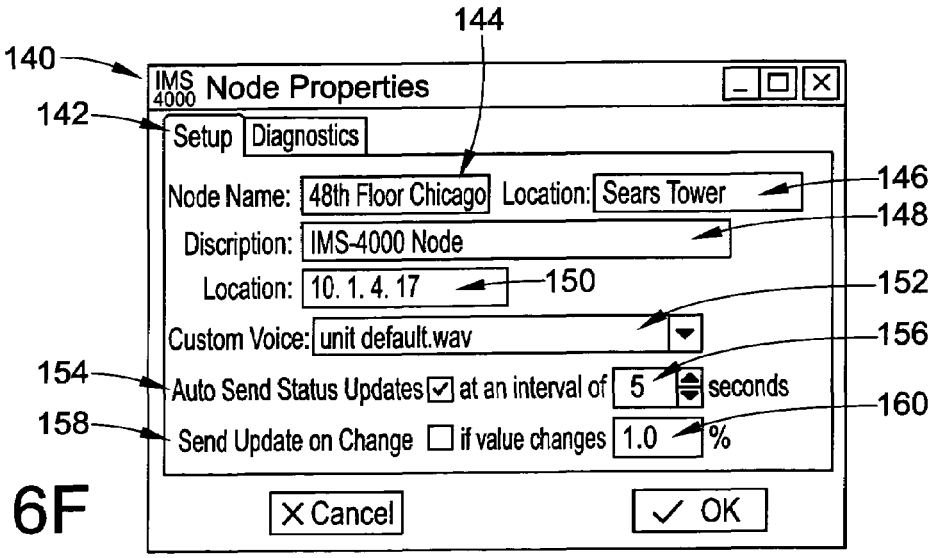
Figure 6G:
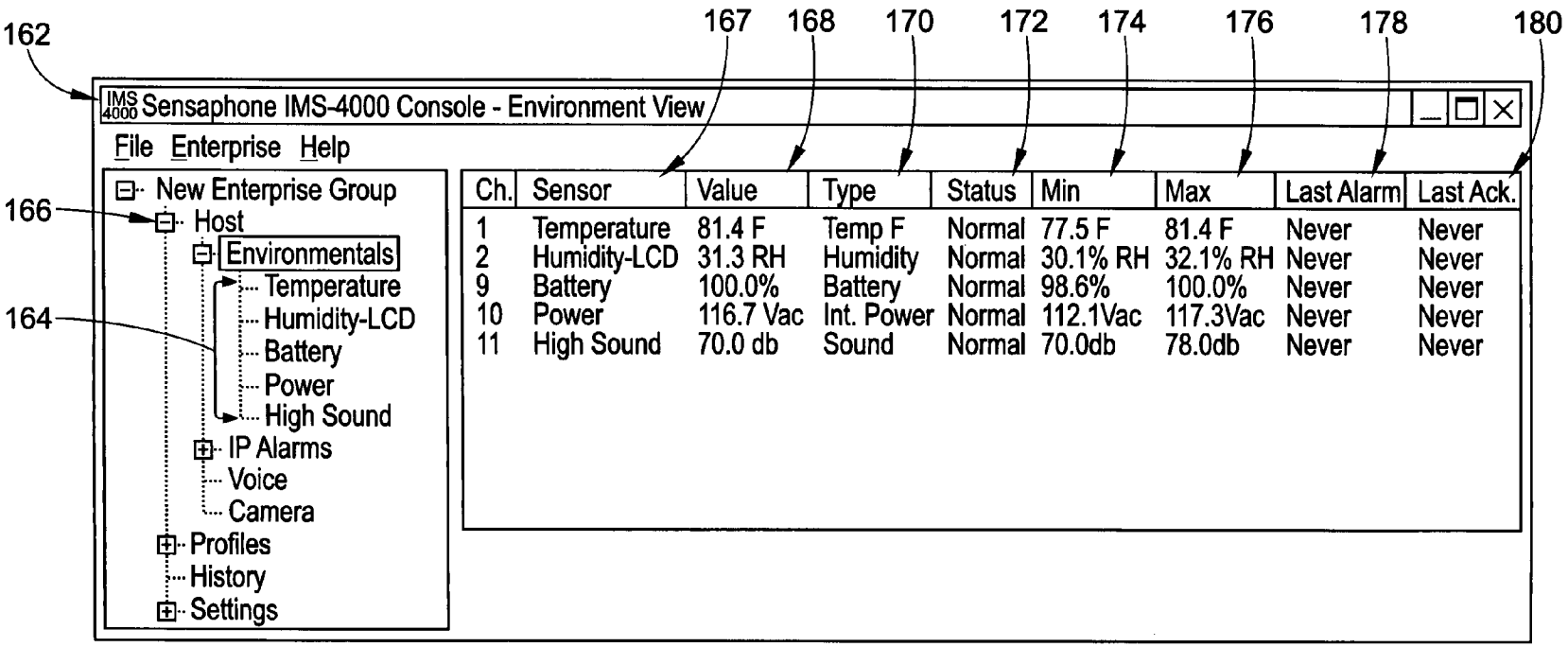
Figure 6H:
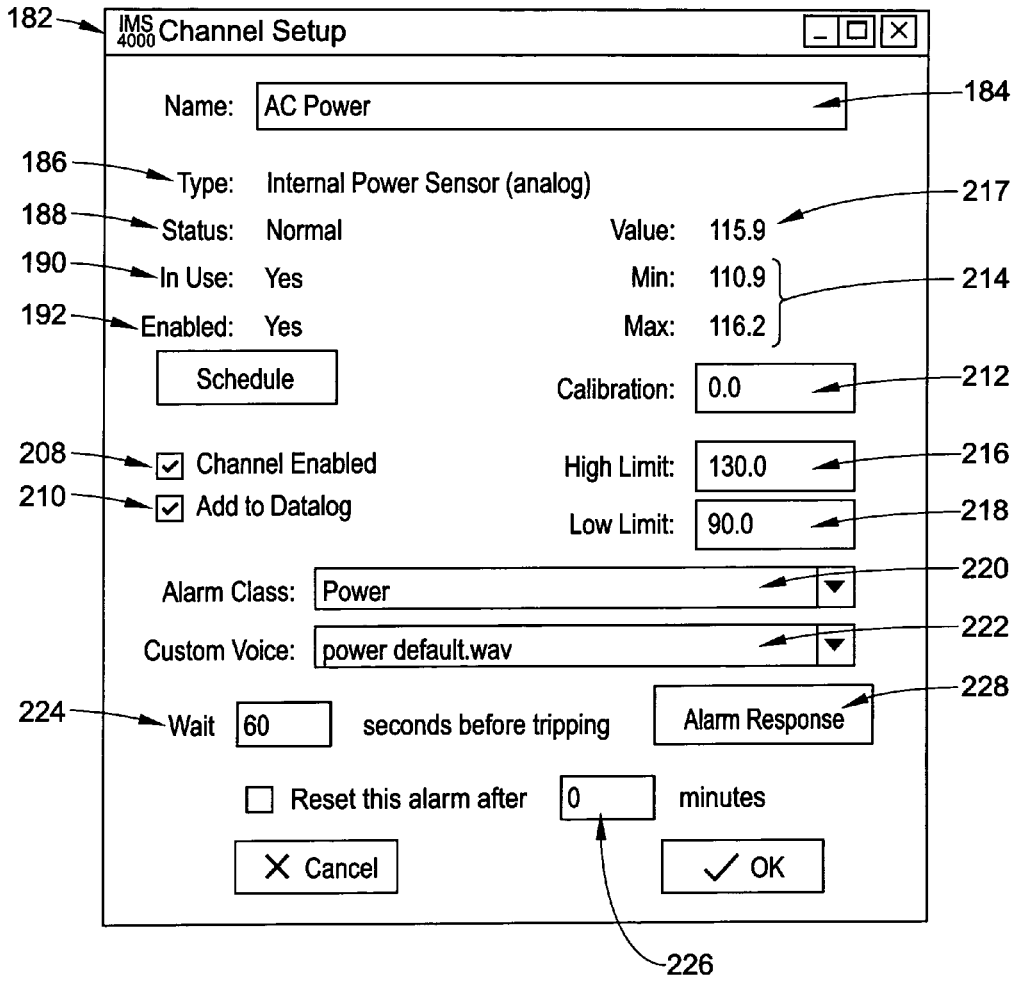
Figure 6I:
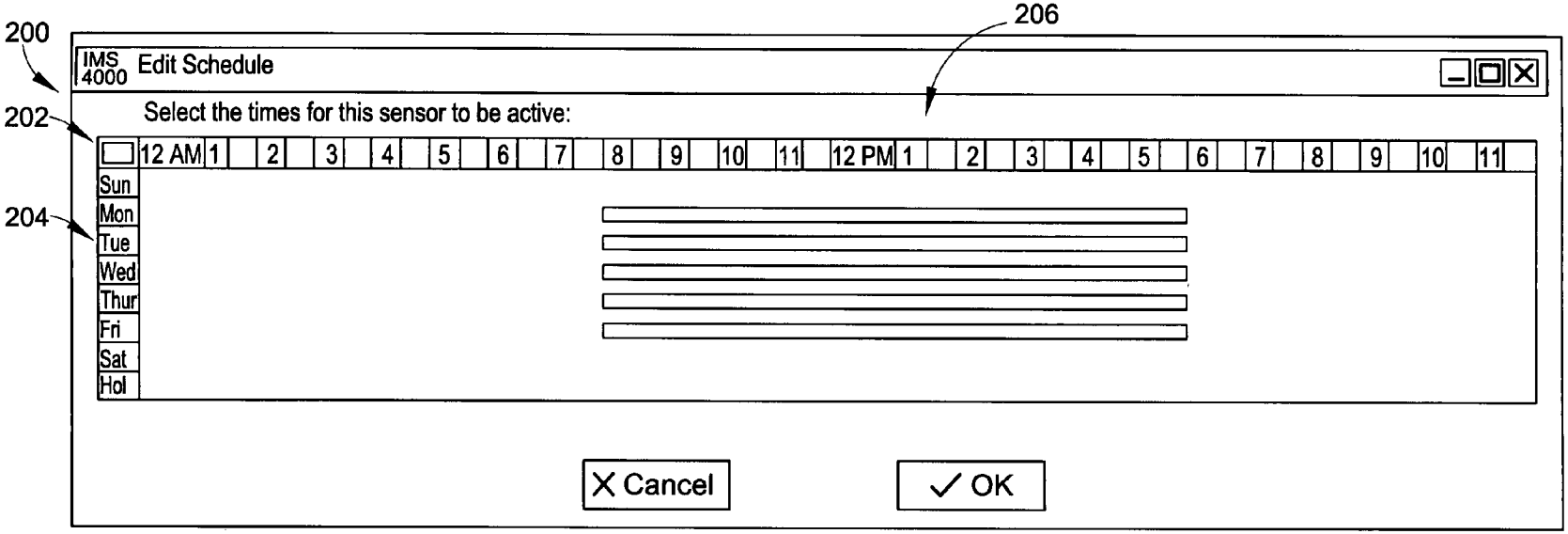
Figure 6J:
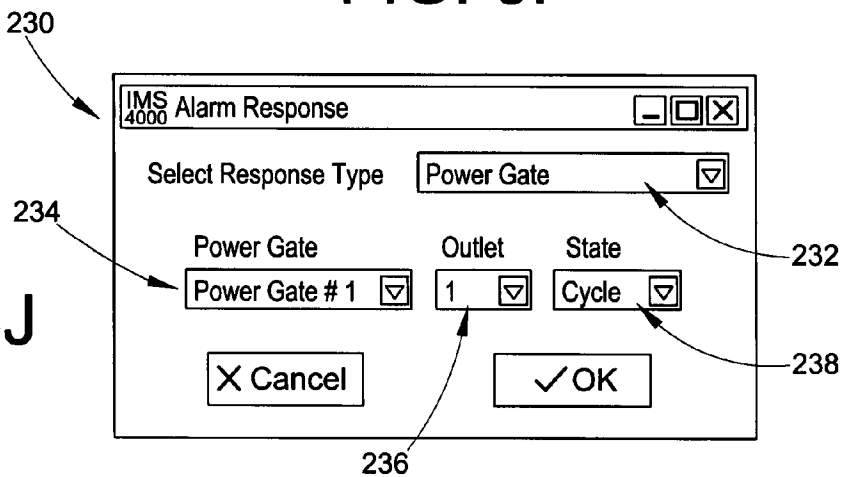
Figure 6K:
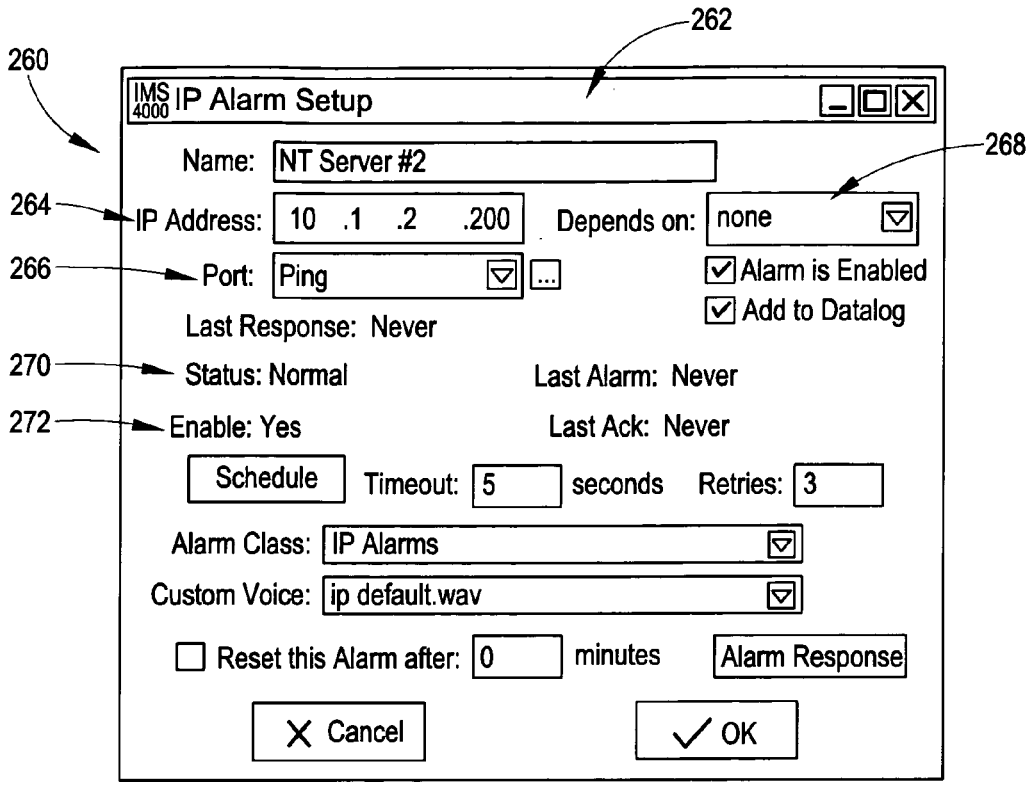
Figure 6L:
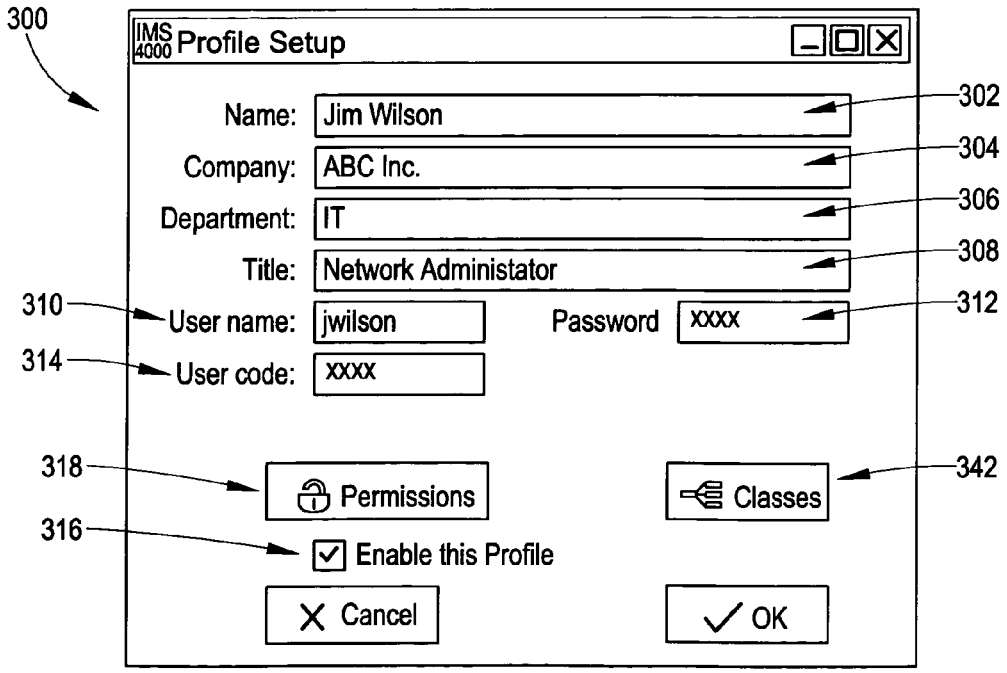
Figure 6M:
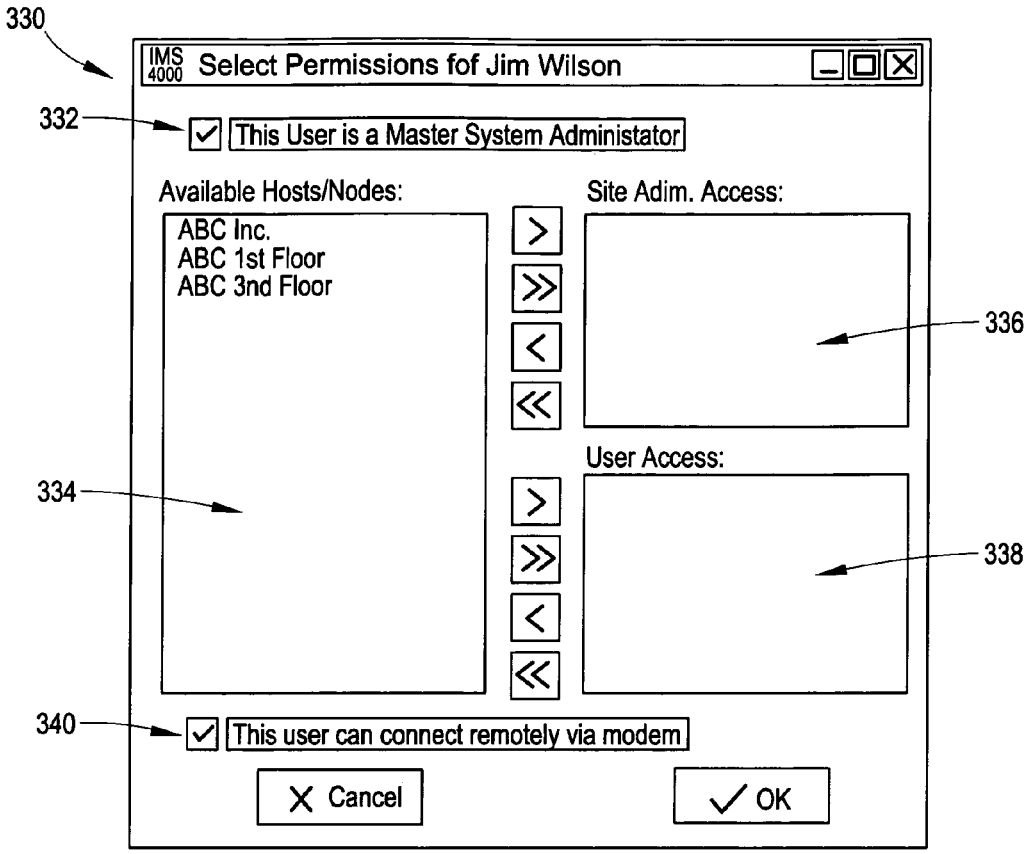
Figure 6N:
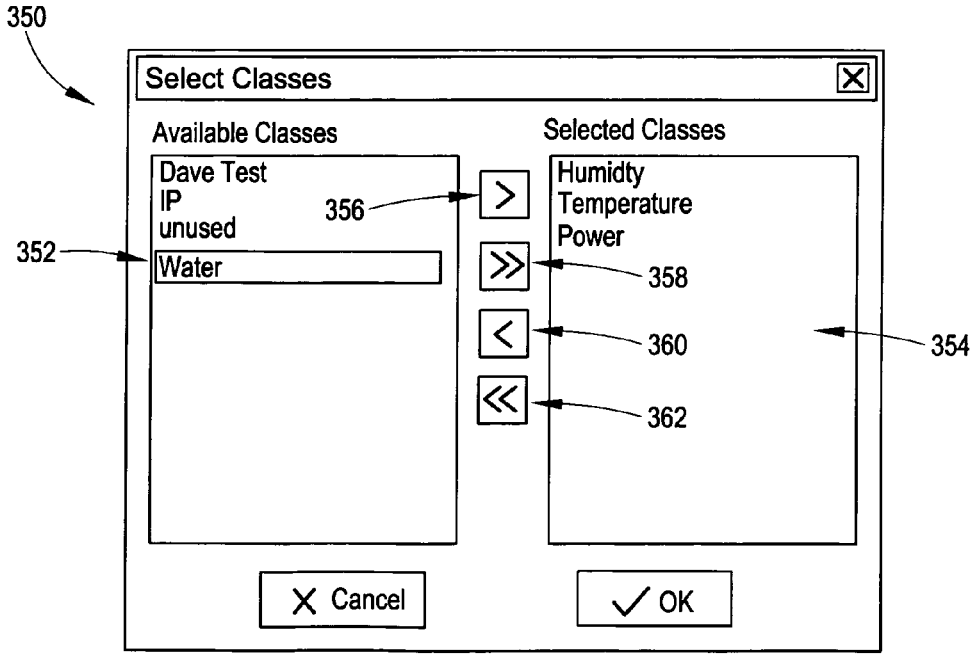
Figure 6O:
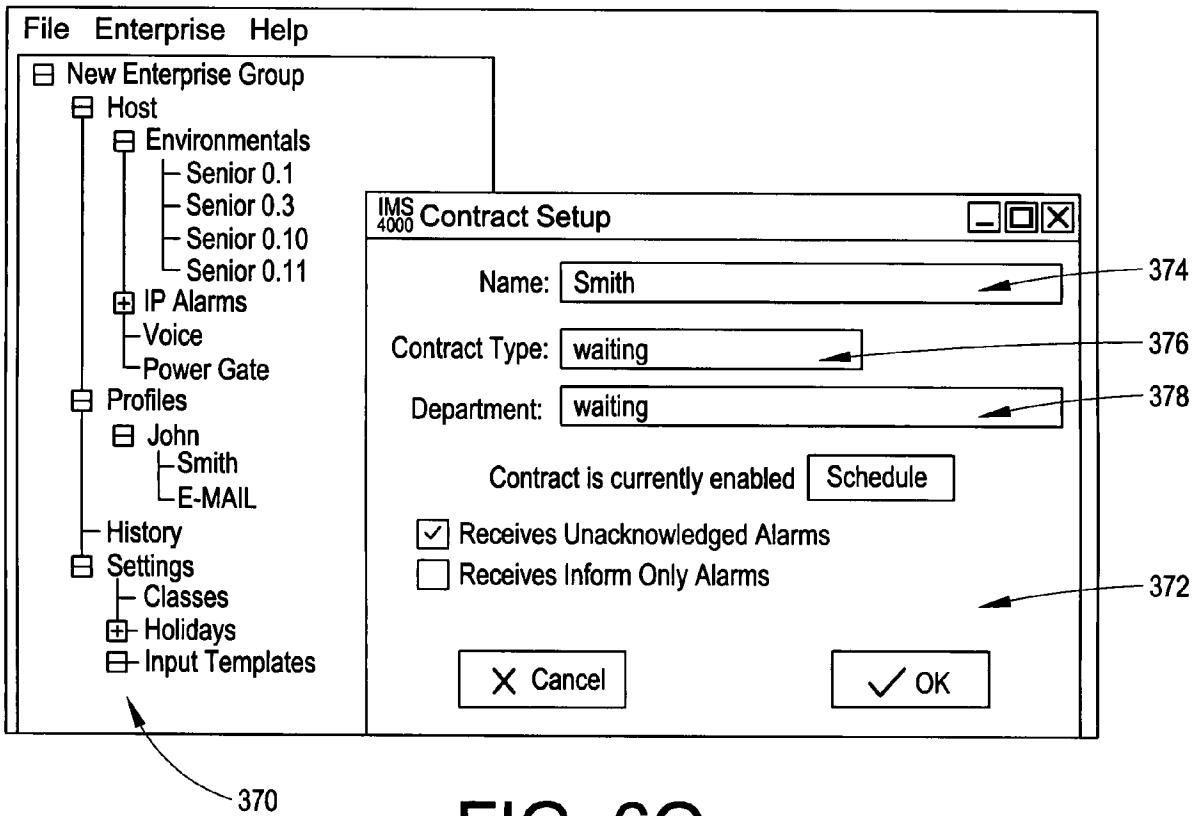
Figure 6P:
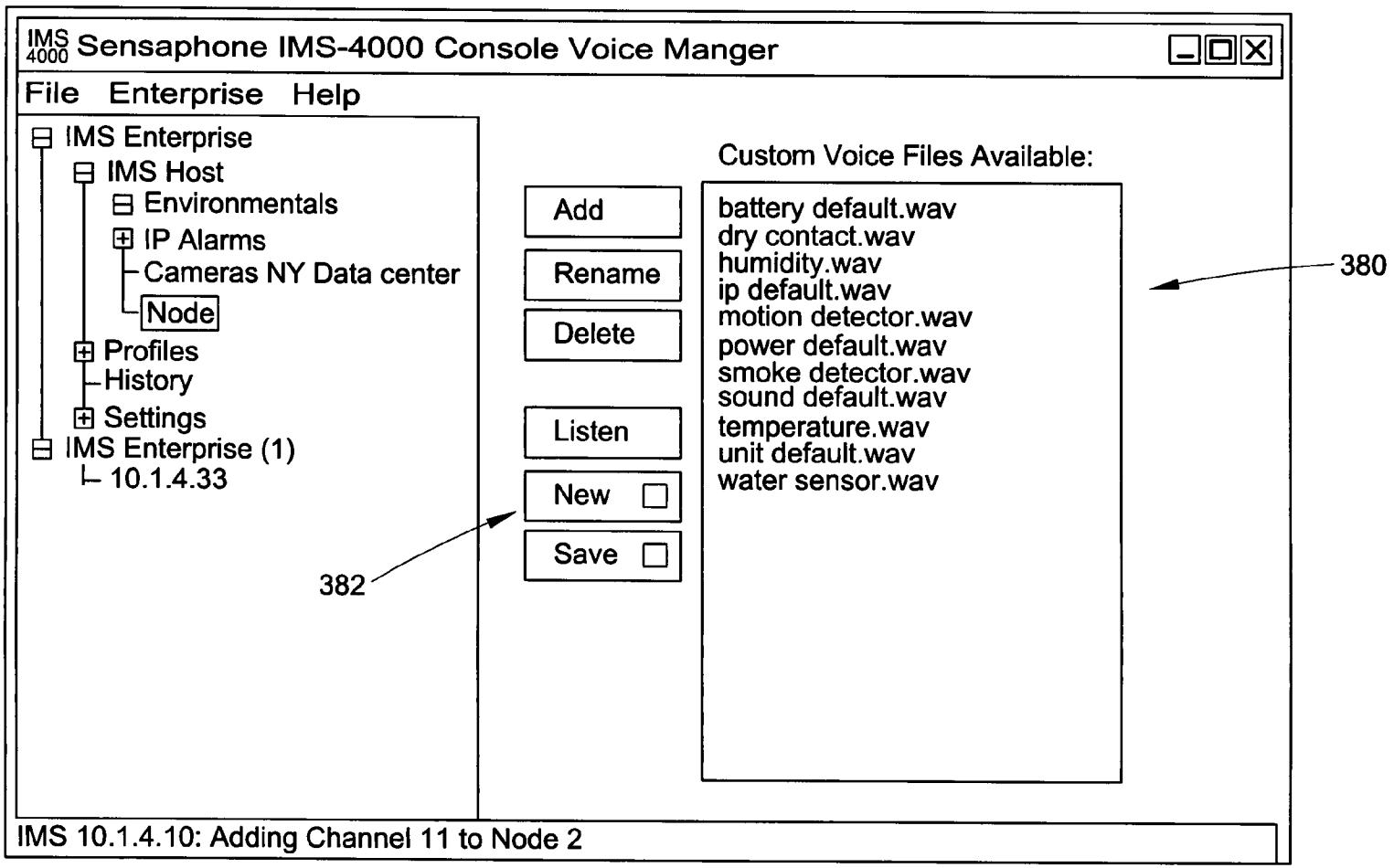
Figure 6Q:
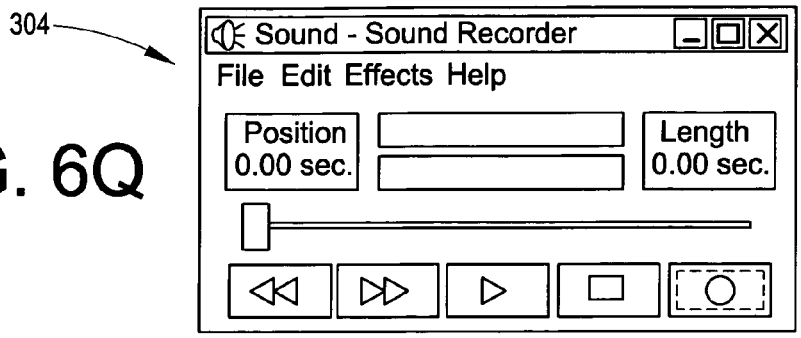
Figure 6R:
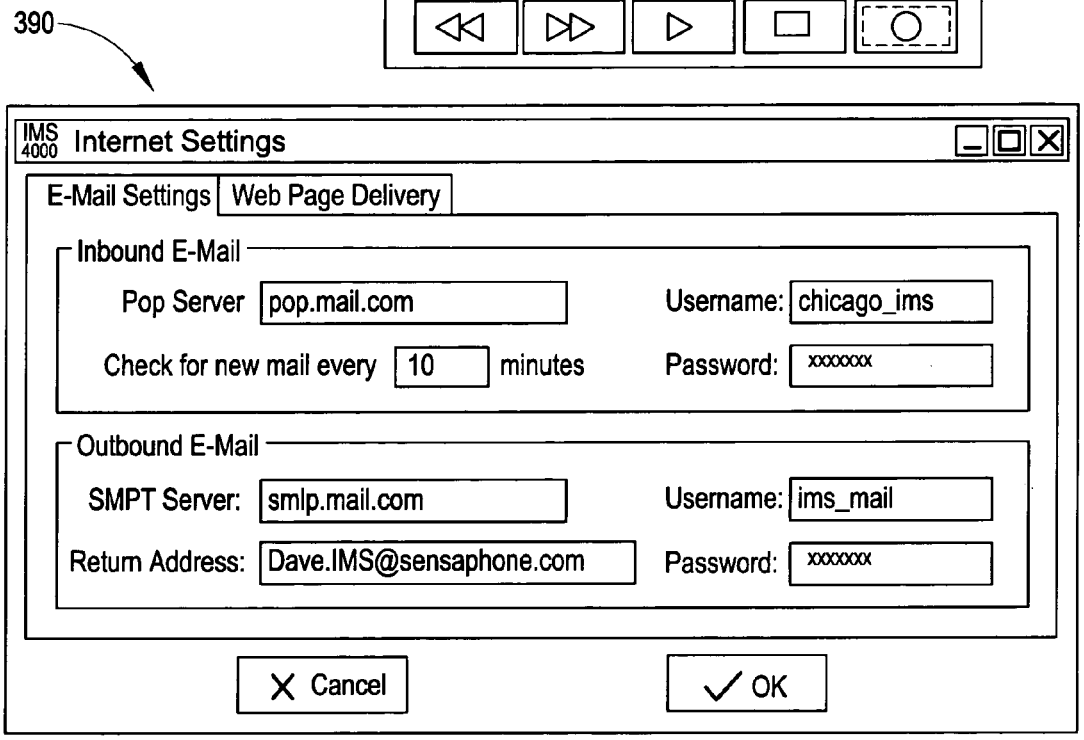
Figure 6S:
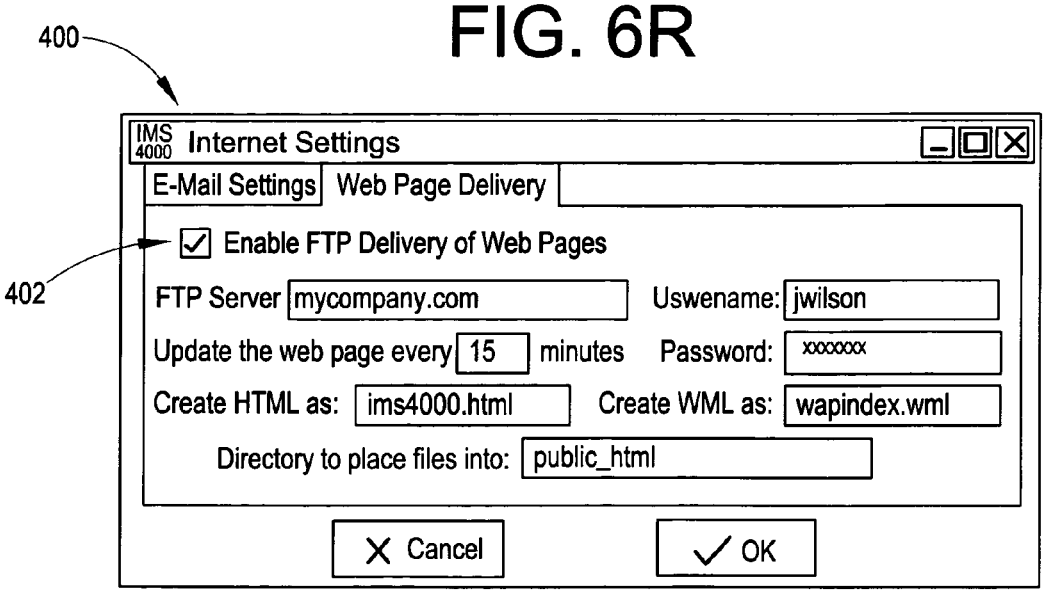

FIGS. 6A–6S illustrate the process flow of the interface control program, as a user configures a Host and Node, where an initial step is to locally configure the Host and Node.

The serial port of Host 10 provides a path by which configuration settings and security options are transmitted to the Host. A dumb terminal or terminal emulation software may be used to perform the setup configuration, where in one embodiment, the serial port is a male DTE, and therefore a null modem cable design may be used. Terminal communication settings may be set to 9600 baud, no parity, eight data bits, one stop bit. In one embodiment, to implement the configuration of Host 10 the terminal of the computer or other system being used is connected to serial port 12 by pressing the (return) button, prompting display of a menu (1-E) to guide the User through the Host configuration process, such as displayed below:

1. Display Enterprise status
2. Display Network and Option configuration
3. Configure Network settings
4. Configure Enterprise Name
5. Configure Web Server
6. Configure Remote Access Server
7. Enable Two-Way E-mail Responder
8. Enable Microphone Listen-In
9. Enable default Master Administrator Account (temporarily)
10. Enable data modem A. Change Admin Password
B. Reset To Factory Defaults
C. Display Statistics
D. Reboot
E. Logout Once the correct password is entered, one of Options 1-E are selected. If Option 1 is selected, a User sees the name of the system device (Unit), the IP address (Type IP) and status (Status) of the Host and all associated Nodes. Thus, the example shown below indicates that this system includes a Host named—IMS-4000 monitor—and a node named—NY_Node—. The IP address for these units are displayed as well as their present Status.

Enterprise Status

| Unit | Type IP | Status |
|---|---|---|
| IMS-4000 Monitor | Host 10.1.4.10 | Ok |
| NY_Node | Node 10.1.4.17 | Ok |

Option 2 displays the network configuration for the Host as well as a web server, Remote Access Server (RAS), and two-way e-mail settings. The details of two-way e-mail will be described in greater detail in following sections of the discussion. A sample display of Option 2 is shown below:

Network and Option Configuration

| | |
|---|---|
| Physical Address | 00:D0:C9:37:40:86 |
| IP Address | 10.1.4.10 |
| Subnet Mask | 255.255.255.0 |
| Default Gateway | 10.1.4.1 |
| DNS Server | 10.1.2.111 |
| Enterprise name | IMS Enterprise |
| Web Server | Enabled |
| Web Server Security | Disabled |
| Remote Access Server | Enabled |
| RAS IP Port Address | 0.0.0.0 |
| Two-Way E-mail Responder | Enabled |
| Microphone Listen-in | Enabled |
| Datamodem | Enabled |

Selection of Option 3 allows the setting of all pertinent network settings listed under Option 2, including the Physical Address, IP Address, Subnet Mask, Default Gateway, and DNS Server. Option 4 allows for the configuration and/or reconfiguration of the Enterprise Name. The User is permitted, by selection of Option 5, to configure the Web server, and when Web security (e.g., Web Server Security) is enabled, a Profile Username & Password must be entered to view the web page. A sample of the Web configuration menu is listed below:

Configure Web Server
1. Enable/Disable Web Server
2. Enable/Disable Web Password Security
3. Return to main menu Returning to Menu 1-E, selection of Option 6 allows for configuration of a RAS (Remote Access Server). This option is set to provide remote access to the network via a dial-up connection to the Host. A sample RAS menu is shown below:

Configure Remote Access Server
1. Enable/Disable RAS Support
2. RAS IP address
3. Return to main menu The enablement and/or disablement of the two-way e-mail feature is accomplished via Option 7, and the monitoring of on-site sound through either the built-in or an external microphone is selected via Option 8.

Option 9 provides an Enable default Master Administrator Account (temporarily). This setting is commonly used in the event that no Master Administrator accounts can be accessed (e.g., the password(s) were forgotten). Enabling this feature temporarily loads the default Master Administrator account (username: admin, password: ABCD), and this temporary account will unload if any one of the following occurs: (1) Any of the Master Administrator accounts is edited, (2) A new Master Administrator account is created, or (3) The system reboots.

Inbound modem communications are disabled via Option 10, while still allowing outbound data connections for fax, alpha page and voice communications. This feature is provided for systems which cannot have a device with a modem connected to the network.

Option A permits the changing of the Local Configuration password, Option B allows the User to reset all settings to their default values, and Option C is selected to display statistics. Option D saves all changes and reboots the system, as a reboot is required for changes to take effect, and Option E saves all changes and logouts, but the changes will not be activated until the system reboots.

Following the configuration of the Host as described, a Node within the system may be configured through its serial port. A dumb terminal or terminal emulation software is used to undertake the configurations. Further, in this embodiment the port is a male DTE so a DB9 female-female null modem cable may be used. Terminal communication settings may be set to 9600 baud, no parity, 8 data bits, 1 stop bit. Once the User has connected their terminal from the computer or other data device to the Node, depressing the "return" key displays a menu to guide a User through the Node setup operation, as below:

1. Display Network configuration
2. Configure Network settings
3. Display statistics
4. Reset to factory defaults
5. Reboot
6. Logout Selection of Option 1 displays Network Configuration settings such as shown below:

Network Configuration

| | |
|---|---|
| Physical Address | 00:07:F9:00:01:93 |
| Parent Host IP Address | 10.1.4.10 |
| Node IP Address | 10.1.4.11 |
| Subnet Mask | 255.255.255.0 |
| Default Gateway | 10.1.4.1 |
| NDS Server | 10.1.2.111 |
| Node name | 48th Floor Chicago |

Selection of Option 2 permits programming of the network settings. It is to be appreciated that a Node must have network visibility of its associated Host 10 for proper operation. Network changes may be designed to take effect upon rebooting of the node.

Option 3 displays operating statistics of the Node, which may be useful for troubleshooting. A sample of which is shown below:

Statistics

| | | | |
|---|---|---|---|
| Running (hrs) | 0 | Disk free (KB) | 209 |
| Ram free (KB) | 7136 | Error mask | 0 |
| IP alarms | 0 | Input alarms | 0 |
| Pkt rcvs | 24 | Pkt xmts | 4 |

-continued

| | | | |
|---|---|---|---|
| Pkt errs | 0 | Ack timeouts | 0 |
| Clock timeouts | 0 | Socket closes | 0 |
| Socket errors | 0 | Socket connects | 1 |
| Avg Pkt RTT (ms) | 20 | Input Prog timeout | 0 |
| DSP proc starts | 1 | IP proc starts | 1 |

Option 4 resets the Node to factory default settings, and all programming and network settings will be deleted. Option 5 permits rebooting of the system, wherein a reboot is used for new Network settings to take effect. Selection of Option 6 will result in a logout without rebooting.

Once configuration of the Host and/or Node has been completed and the interface software installed, system configuration is undertaken. Particularly, upon the initial operation of the control or interface software (i.e., as depicted by FIGS. 6A–6S), an Enterprise Group is generated including a Host or Hosts, and a Node or Nodes connected to the Hosts, and all associated environmental sensors. It is to be understood that a system may exist entirely of a single Host.

The User logs onto the interface software by a variety of known techniques, including clicking on a Host software icon installed on a User's screen. Selecting the Host software icon will display a console screen 100 of FIG. 6A, including a menu having Enterprise button 101 which, when selected, permits the User to enter a new Enterprise name. In this example, the Enterprise name is "New Enterprise Group" 102.

To add a configured Host to the Enterprise Group, the User inputs the Host IP address and, thereafter, their Username and Password. Once this information has been entered, connection to the Host is initiated. This connection will take place via a connection or other appropriate communication network. If a Host was previously connected to the Enterprise Group, connection is made simply by entering the Username and Password.

Once the Host has been incorporated within the New Enterprise Group, properties or parameters for the Host—as related the overall system—are entered. To begin the process of entering parameters, the Host name (i.e., "HOST") 103 is selected from the hierarchical tree, which provides for a display of Unit Properties screen 104 of FIG. 6B. Selection of System Info tab 106 provides a Unit Name area 108 for input of the location of the HOST, a Description area 110 for entry of the name of the HOST (e.g., HOST XYZ) and a Location area 112 which describes the geographic location of the unit. A User is also given the opportunity to select an "Auto-Connect on Startup" box 113 if it desired that the software connect automatically with Host 10 during startup.

Next, shown in FIG. 6C, the Dial-out Settings tab 114 is selected for further input of properties. At this screen, the telephone number of the Host in the Numeric Unit ID field 116 is entered. The Numeric Unit ID will appear on alarm messages delivered to numeric pagers and fax machines.

The User is further provided with an opportunity to select a custom voice message to identify the Host by clicking on an arrow in the custom voice field 118 and selecting a voice file from displayed options. Custom voice messages can be recorded and uploaded to a Host on the custom voice manager screen which will be described at a later point in this application. The Host custom voice message is the first message spoken during a voice call, and describes the name and location of the Host.

The number of times the system is to attempt to call a contact is entered in Dial-Out Attempt field 118. Next, the User will enter the desired alpha numeric pager speed 122. Typically, 1200 bps will work appropriately with most pagers. If the phone system does not produce a dial tone when the receiver is first lifted from the cradle, the User will check the "Do Not Check For Dial Tone" box 124.

Turning to FIG. 6D, Unit Properties screen 104 is displayed when Clock Settings tab 126 selected. The time zone of the Host 128 and the IP address of a compatible time server 130 are supplied when the User intends to synchronize the clock of the Host. To use this feature, access to a server which supports at least one of the following time code protocols: Network Time Protocol-NTP (RFC-1035); Time Protocol-TP (RFC-868); or Day Time Protocol-DP (RFC-867), is needed.

Following these operations, the Host is made part of the Enterprise Group, and provides the unit properties for operation within the system. With attention to inclusion of a Node into the Enterprise Group, once the Node is connected to the network (and the Local Configuration has been performed), the Node will automatically begin communicating with the Host.

Turning to FIG. 6E, depicted is tree structure 132 (similar to FIG. 1) where the "New Enterprise Group" is shown to include Host 134 and Node ("Node 1") 136. In this design, the Node name will appear in a first color (e.g., green) when Host to Node communication is working properly. If communication problems occur, the Node name will initially turn to a second color (e.g., yellow), to indicate that pending Node trouble exists. If the problem persists for several minutes, the Node name will turn to a third color (e.g., red) and a trouble alarm is dispatched to members of an appropriate diagnostic class.

Turning to FIG. 6F and similar to the Host, the Node (Node 1) will also be provided with properties for operation within the system. Particularly, as shown in FIG. 6F, Node Properties screen 140 presents Setup tab 142, wherein selection of Setup tab 142 allows the User to enter a Node Name 144, a Location 146, a Description 148, an IP node address 150, and to select a custom voice 152. Additionally, the User may select to send automatic status updates by selecting box 154, and the specific interval of those updates 156.

During normal operation, information is periodically passed between the Host and Node. This information mainly consists of current input values and IP alarm statuses. The amount of data transferred during this update may vary, but in one embodiment will be about 700 bytes. By selecting the auto send option, the User has the ability of selecting when this information is transferred, via Change box 158, and a value of Changes 160. Based on this information, the Node will only send an update when a sensor value increases or decreases by the percent box programmed. It is to be understood that if an actual alarm is detected, the Node will transmit the alarm information to the Host immediately.

As previously described, each Host and/or Node may have a plurality of attached sensors. The Host and/or Node will identify the sensor type connected to each input. Particularly, as shown in FIG. 6G, an Environmental View screen 162 lists the sensors 164 attached to a Host 166. The right section of the screen, shows the sensors with the displayed sensor name 167, the current value of the sensor 168, the type of value being tested (such as temperature, humidity, battery, etc.) 170, the present status 172, the minimum and maximum values allowed prior to an alarm issuance 174, 176, the last time alarm occurred 178, and the last acknowledgment sent 180. Thus, screen 162 gives a clear view of the sensors and the parameters associated with a particular Host or Node.

Whereas screen 162 gives a view of the system, other screens provide a capability to enter settings of parameter values. FIG. 6H, for example, depicts a Channel Setup screen 182 which shows what the sensor is monitoring 184 (for example AC power, mail server, data center, rack number etc. . . . ); a sensor type 186, which is automatically determined when the sensor is plugged into the Host or Node; the sensor status 188 to indicate if the sensor is presently within alarm limits; an In Use entry 190 which indicates that a valid sensor is plugged into the channel described; and an Enabled entry 192 which indicates if a channel is currently enabled for alarm monitoring. If the channel is disabled (i.e., Enabled entry 190 set to No), the Host or Node will not send alarm messages. The channel can be automatically enabled and/or disabled based on a scheduling system.

Such a schedule is shown, for example, in FIG. 6I as Edit Schedule screen 200. Each sensor will have an associated Edit Schedule screen 200 where operation times may be selected. In the left-hand corner, an ALL button 202 enables or disables a specific sensor. For more refined operation, the User may click on the day buttons 204 located on the left side of the grid, and click on the hour buttons 206 across the top of the grid to enable specific days and hours when an alarm is to be operative.

Returning attention to FIG. 6H, selection of a sensor channel box 208 enables the associated channel. By selecting the data log box 210, the value or status of the channel associated with the sensor will be stored in a data logger. The calibration box 212 may include a positive or negative offset to calibrate a sensor value. The value Minimum, Maximum and Value entries 214, 215, 217, respectively, determine the minimum and maximum values reached by the sensors since it was connected to the Host or Node, and the present value of the sensor. The high limit and low limit boxes 216 and 218 are the sensor high and low alarm limits. When the value exceeds these limits for a predetermined time (box 224), an alarm will be tripped. The alarm class 220, when selected, provides a drop down menu that allows the User to identify the alarm class such as a power, temperature network humidity, UPS security, or other class, included self identified created classes.

In the custom voice block 222, a drop down menu is provided for selection of the custom voice message for the particular sensor/channel. The voice messages can be recorded on a computer and uploaded into the Host or Node on the custom voice manager screen (which will be described below).

The wait box 224 is time required for a fail condition to qualify as an alarm event. This sensor/channel must remain beyond the limits or be in a fail condition continuously for this entire period of time in order to become an alarm. The reset box 226 includes the time the system allows for acknowledged alarm fault conditions to be corrected before the Host or Node reactivates the alarm and begins another message delivery process.

Lastly, the alarm response button 228 causes the generation of an Alarm Response screen 230, of FIG. 6J. The type of response to be taken upon receipt of an alarm is entered in the Select Response Type box 232. Also entered is the name of the device which will respond (e.g., Power Gate #1) 234, the outlet 236 and intended operation (i.e., ON, OFF, CYCLE) 238. In one embodiment when an alarm occurs, the power units outlet automatically may turn ON, turn OFF, or CYCLE power to a device. Cycling will switch the outlet OFF for a predetermined time and then switch it back ON.

Another feature of the present system, is the ability of the Host/Nodes to measure the sound level with the built in microphones provided in the units. This is useful in detecting audible alarms in close proximity to the Host or Node. To detect alarms at a distance from the unit, an external microphone may be used by plugging it into the provided microphone jack (as shown in FIGS. 1–2). To avoid extraneous noise from setting off alarms, the type of signal which is recognized by the Host and/or Node is controlled. For example, the system will recognize criteria a steady or pulsing signal such as a smoke detector alarm, while other noises are filtered or ignored.

As previously described, each environmental (i.e., non-IP) input automatically detects the type of connected sensor (i.e., temperature, humidity, power, motion . . . ). This may be accomplished in a variety of ways, including having the sensor generate a unique identifying signal for the Host or Node. Analog sensors include high and low alarm limit programming options while 2-state sensors (normal/alarm) simply have recognition times.

Turning to alarm generation, in one embodiment, an Environmental Alarm is dispatched when the following criteria are met:

a) the sensor is enabled—as configured through the schedule;

b) the programmed high or limit is continuously exceeded for the duration of the wait (recognition) time. For two-state sensors, it needs to be in the alarm state, continuously, for the duration of the wait (recognition) time;

c) the sensor is a member of a Class; and d) there are one or more User profiles which include this class.

The concept of Class and User Profiles will be expanded upon later in this description.

Turning to Internet protocol (IP) alarms, each Host or Node may monitor up to 64 IP addresses through pinging and port availability methods. In addition, IP dependencies can be programmed to prevent multiple alarm messages from being sent when common network paths are down.

IP alarm parameters may be programmed via an IP alarm set up screen 260 as shown in FIG. 6K. Supplied is an area to enter a name 262 of the device which is to be monitored, an IP address and a selection (Port box 266), to select the mode of monitoring. A dependency box 268 indicates if and what IP address must be active for the monitored IP address (box 264) to be able to respond. In other words, the monitored IP address is dependent upon the dependency IP address to function.

Status entry 270 displays if the IP address is presently responding. A "Normal" status display indicates the IP device is responding within the limits of the time-out retry parameters. A "Ping Time-out" status display indicates that the IP device is not responding within the time-out and retry parameters, and an "IP Route Down" status display indicates that the dependency IP is not responding and therefore the IP address cannot be reached.

When the "Enabled" state 272 is "Yes", the IP address is currently enabled for alarm monitoring, and when it is "Disabled" or "No", the Host or Node will not send alarm messages. An IP alarm can be enabled or disabled based on an operation scheduler such as described in FIG. 6I. It is noted that the Last Response, Last Alarm and Last Acknowledge (ACK) data areas display the time and dates that the IP device last responded, had its last alarm or the last time the IP for this channel was acknowledged.

Figure 7:
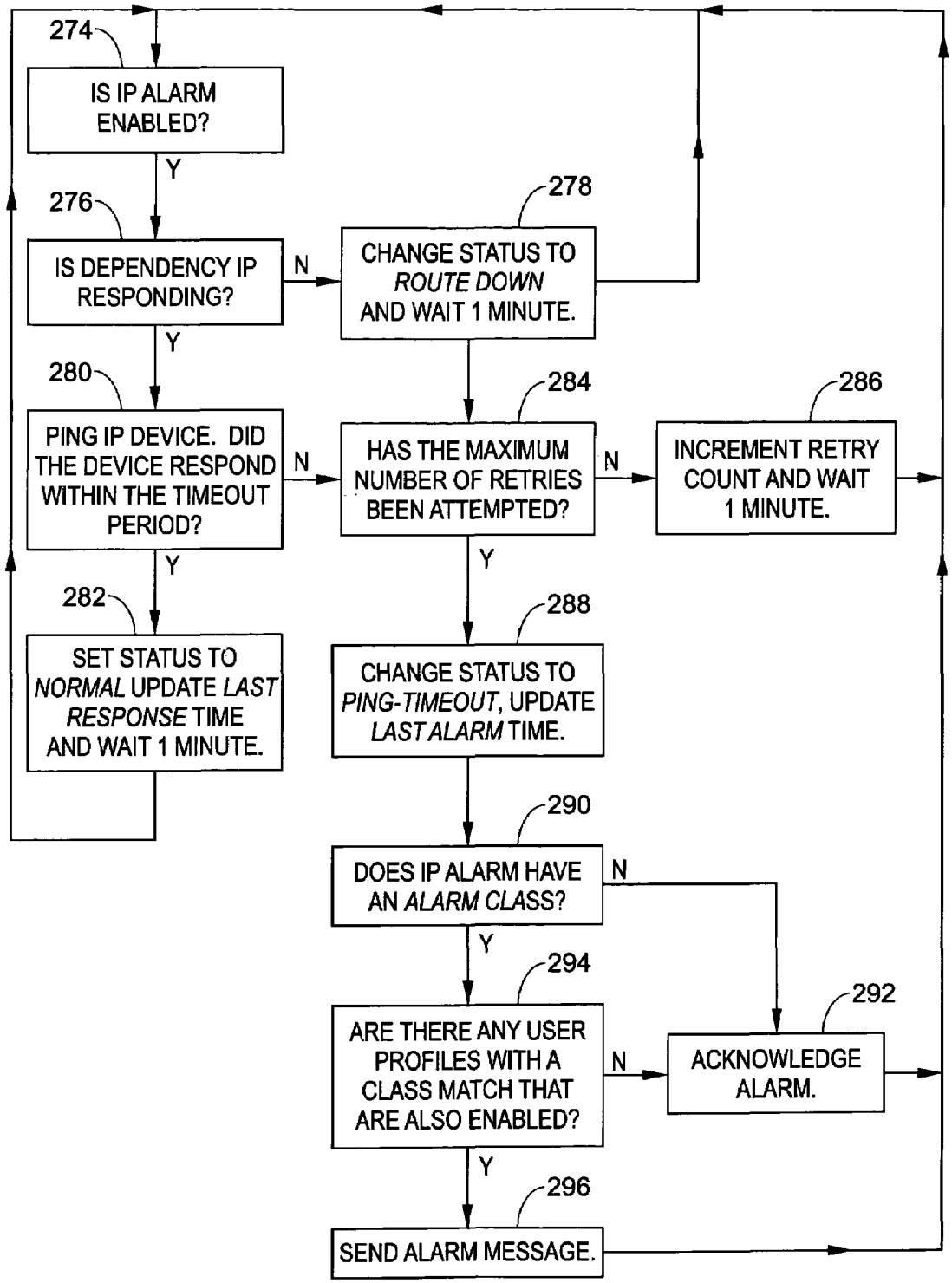
FIG. 7 is flowchart for IP alarm generation.

With specific attention to the process flow of an IP alarm issuance, attention is directed to FIG. 7. Initially, the Host or Node makes an inquiry as to whether an IP alarm is enabled, 274. Particularly, a host/node will only attempt to ping/connect to sensors which are presently enabled based on their respective schedule. Once it is determined a sensor is enabled, the process moves to step 276 wherein a determination is made as to whether a dependency IP is responding. It is noted that a dependency device (not shown, but it may be a server at an IP Dependency Address) can be programmed for each IP alarm, and is used to prevent numerous alarms from occurring when common network infrastructures problems arise. If the dependency device fails, then all IP alarms that have this dependency will be temporarily disabled from sending alarms until the dependency device returns to normal (i.e., starts responding to ping/connect request).

If the dependency is not responding, the sensor status is described as "Route Down" and a predetermined time must pass before a next attempt to contact that sensor address occurs (step 278). In some situations it is considered beneficial that the dependency device be programmed such that it will enter into an alarm state before other devices. This can be achieved by setting the number of retries for the dependency device to a lower value than the IP alarms which rely on this device.

If in step 276, the dependency IP is responding, the process moves to step 280, where the system attempts to ping/connect to the monitored IP device (sensor). An inquiry is made as to whether the IP device responded within a selected time limit (i.e., the ping time out). If the device (sensor) does respond, the process moves to step 282 where the status of that sensor is set to Normal and the Last Response time data is updated. Then the process waits for another predetermined time limit in which to contact the sensor.

However, if at step 280 a response did not occur from the sensor, within the time out period, the process moves to step 284, and an inquiry is made as to whether the maximum number of retries have been attempted. If the maximum has not been attempted, the process flows to step 286, which increments the recount try and will then wait for predetermined time (e.g., one minute) until another attempt is made to contact the device.

When, at step 284, the maximum number of retries have been attempted, the operation moves to step 288. For example, if the ping retries is set to three, then the host/node must fail to ping/connect to the sensor four times in a row (initial attempt plus three retries) to exceed the retries maximum and move to step 288. Following changing the status to Ping Time-out, step 290 generates an inquiry as to whether the IP alarm has an alarm Class. Should no alarm Class exist, the system moves to an acknowledge alarm process, as previously discussed.

At step 290, when the IP alarm is associated with an alarm Class, an inquiry is made as to whether there are any user profiles with a Class match that are also enabled (step 294). Again, if no User Profiles have a Class match, and are enabled, the Acknowledged Alarm is implemented in step 292. However, if there is a User Profile which matches with the Class of enabled sensor, the process moves to step 296 wherein an alarm message is generated.

In summary, an IP alarm is dispatched, when the following criteria are met:

a) the IP Alarm is enabled—as configured through the schedule,
b) it has failed to respond to consecutive ping/connect requests and exceeds the number of retries,
c) it is a member of a class, and
d) there are one or more user profiles which include this class.

Once the alarm is dispatched, the alarm delivery process begins. If any of the contacts are programmed as Until Acknowledged, then the Last Acknowledge (Last Ack) time is updated when the alarm has been acknowledged. In the case where all contacts are set to Inform Only, the Last Acknowledged time will update immediately after the alarm occurs.

In this embodiment, an option is provided to re-dispatch the alarm if it remains in an alarm state past a set time. This programmable time period is called the Alarm Reset Time. This parameter can be set from 1 to 4000 minutes and preferably from 30 to 3600 minutes. For example: Suppose the Alarm Reset Time is set to 180 minutes. Now suppose an IP device has stopped responding and trips an alarm which results in all programmed users receiving their respective messages. If the IP device continues to remain unresponsive for 180 minutes, then the alarm will be dispatched again and all appropriate parties will be contacted once more.

Turning attention to the use of Classes in this application, Classes associate Environmental inputs and IP alarms with specific persons. The person, via configuration of their User Profile, selects Classes for which they have responsibility. A number of predefined Classes exist (e.g., diagnostic, temperature, humidity, water, power, smoke, security, backup battery, high sounds, IP alarms). However, a User may also generate their own by creating a Class table.

FIG. 6L illustrates a User Profile Setup screen 300 which permits for the input of profile information including the person's name 302, company name 304, user's department 306, the title of the person 308, the person's User name 310, password 312, and User code 314. The name, company, department and title information is used to identify the User on reports that are issued by the Host. The User name, password, and User code are implemented for security purposes. It is necessary to have User name and password to go online with the Host, to request two-way e-mail features, and to access other features of the Host.

When an alarm occurs, the Host/Node checks the list of User profiles to see who should be contacted. Users whose Class list includes the Class of the alarm will be contacted. Each User can have multiple contact designations (i.e., phone numbers, e-mail addresses, . . . ). In this embodiment, up to sixty-four different User profiles can be created and the Host can contact Users by at least six different methods, including voice, pager, alpha numeric pager, fax, e-mail, and SNMP trap.

The User code is a four digit number that is required to request a voice status report and to acknowledge alarms. When the Host receives a call, it will request the User code. If a valid User code is entered, the unit matches this code to the Users Class list and reports the status of all environmental inputs and IP alarms which correspond to the selected Classes.

A particular feature of this system is the use generation of voice status reports which will be described in greater detail in the following section. In this discussion, it is noted that when a voice status report is made, a User's permissions will be checked, whereby a User can only receive information for items they have permission to receive. This includes environmental and IP alarm statuses, power switching, ping requests, and microphone listen-in operations.

Checking the "Enable This Profile" box 316 is a convenient way to temporarily enable or disable a User profile. When a profile is disabled (unchecked) no alarms or reports are sent to the User and the User will not be permitted to logon to the system.

Clicking on the permissions button 318 generates Permission screen 330 of FIG. 6M. In this embodiment, there are three access levels: Master System Administrator, Site Administrator, and User. An example of the restrictions which may exist for each security level is as follows:

| | Master System Admin | Site Admin | User |
|---|---|---|---|
| Add user profiles | Yes | No | No |
| Disable user profiles | Yes | No | No |
| Edit unit properties | Yes | No | No |
| Edit e-mail settings | Yes | No | No |
| Edit Node properties | Yes | No | No |
| Update firmware | Yes | No | No |
| Configure data logger | Yes | No | No |
| Add/Delete classes | Yes | No | No |
| Add/Delete holidays | Yes | No | No |
| Edit default input templates | Yes | No | No |
| Delete sensors | Yes | Yes | No |
| Disable IP alarms | Yes | Yes | No |
| Reset min/max | Yes | Yes | No |
| Other programming changes | Yes | Yes | No |
| Add camera | Yes | Yes | No |
| Acknowledge alarms | Yes | Yes | Yes |
| Switch a PowerGate outlet | Yes | Yes | Yes |
| Online via local PC | Yes | Yes | Yes |
| Call in via voice | Yes | Yes | Yes |
| Call in via modem | Yes | Yes | Yes |
| Visit password protected Web | Yes | Yes | Yes |

As shown in the Select Permissions screen 330, in order to select a profile as a Master Administrator it is simply necessary to check the Master System Administrator block 332 at the top of the screen.

To configure profiles for a Site Administrator or User security levels, Hosts or Nodes are selected and placed in the appropriate location. For example, block 334 lists the available Host/Nodes, and a User may highlight a particular node and move it into the either Site Administrator access block 336 or the User access block 338. Checking the box "This User Can Connect Remotely Via Modem" 340 at the bottom of the screen 330, allows the User listed at the top of the screen to dial into the system using a modem. When moved to a selected block, the above-listed accesses/permissions are made available.

In addition to controlling programming access when using the console software, permissions also have an affect during a telephone call. In voice mode, the unit recite only menus and status information for devices that the User has permission to hear. The associated classes for each User will also control the content of a voice report, as well as, two-way e-mail. A User can only receive information or send commands if they have the proper permissions and Class associations.

For example, if a User has no Permissions on a particular Node, then the User will not be able to receive any Voice or e-mail reports that contain information about that Node. Also, as another example, if a User has Permissions on a particular Host or Node but none of the environmental sensors are in the User's Class, then the User will not receive any information about the environmental sensors.

Returning attention to FIG. 6L, selection of the Classes button 342 results in display of Classes where the User can choose (i.e., include in their User profile) to receive alarm reports from one or more Classes 352, which are then listed (List 354). The arrow buttons are used to select or deselect Classes. For example, Button 356 moves highlighted classes on the left to the right; Button 358 moves all classes on the left to the right; Button 360 moves the highlighted classes on the right to the left; and Button 362 moves all classes on the right to the left (deselect all).

Additional aspects of setting up the User profile includes adding contacts, such as telephone numbers, e-mail addresses, pager numbers, etc. a Host will contact when an alarm occurs. In one embodiment, it is possible to have at least eight contacts per User profile, and each contact can have its own schedule (i.e., such as in FIG. 6I) so that certain contacts may be enabled during daytime hours and others enabled during nighttime hours. Only contacts which are enabled when an alarm occurs will be contacted. A Contact is added to the User profile by going to the hierarchical tree and expanding the tree as shown in FIG. 6O where the profile 370 is expanded and a new contact may be entered. This is accomplished by generating the contact setup screen portion 372. In this design, the person's name is entered 374 and the contact type is selected, via a drop down menu which provides choices such as voice, numeric pager, alpha pager, fax, e-mail, and SNMP 376. Thereafter, a destination number is input, such as a telephone number, e-mail address, server name/address of the contact 378.

For most voice calls it is possible to simply enter the telephone number of the person who is to be called. Additional codes or descriptors may also be included. Particularly, p=two second pause; w=wait for answer; b=blind dialing (makes the unit dial and start speaking the message without requesting that a key may be pressed); and !=flashes the phone line (momentary hang up and reconnect, useful in some PBX systems).

These codes are particularly useful for automated systems. For example, in one situation, suppose an office was answered by an auto-attendant but it is known that if you dialed the extension the call would be transferred. In this case, the telephone number may be programmed to insert a "w" to wait for the auto-attendant to answer and then add the extension you want dialed.

With attention to numeric pager calls, the Host may send alarm messages to numeric pagers, and automatically sends its ID telephone number when dialing to a numeric pager.

This system can also dial alphanumeric pager calls to send alarm messages. To program an alphanumeric pager destination, the pager service data/modem phone number is entered followed by the letter "a" and then the pager ID. For fax calls, the telephone number of the fax machine is entered, similarly, for e-mails the e-mail address and for the SNMP, the SNMP server IP address is provided in a numeric form (e.g., 192.168.0.1).

Similar to discussion in connection with the scheduling screens (e.g., FIG. 6I), the contact information may also be scheduled. Particularly, it is possible to choose times the contact person wishes to be enabled. This provides flexibility to allow someone to only to be contacted on their shift, or to not be contacted during holidays, etc.

Additional alarm/report options of the present system include a "Receive Unacknowledged" alarm, were this option applies only to voice and pager calls. When selected, the Host will call the contact until the alarm has been acknowledged or until the number of call attempts has been exhausted. If the alarm is acknowledged by another User, this contact will stop being called. A "Inform Only" alarm option is an alarm message for information purposes only. The User cannot acknowledge an "Inform Only" type of call. This selection is useful for insuring that a record of an alarms is sent. A further option is a "Receive Automatic Status Reports" option which when selected results in a contact receiving an automatic status report if the feature is enabled.

In addition to selecting pre-designed voice statements (i.e., in the form of wave files or other voice messaging formats) custom voice messages may be assigned in the present system. Voice messages are also used during call-in status reports as well as alarm dial out. This allows the system to identify and describe exactly where the problem was located, which equipment is effected or which device is not functioning. Custom voice messages may be assigned to the Host, Node, environmental inputs, IP alarms, power gate devices, and power gate outlets.

To record a voice message, selection of the word "Voice" from the menu tree is made. This displays the custom voice manager screen 380 of FIG. 6P. By clicking on the New button 382, a voice generation program such as but not limited to a MSWindows sound recordal program is prompted to the screen as shown in FIG. 6Q. The User may use the sound select recorder 384 to generate a customized sound recording. The saved message are then uploaded and the new message is loaded into the system and appear on the list shown in FIG. 6P.

Expanding upon previous discussions, the Host is configured to deliver a spoken status report when called via telephone. The status report provides information on both environmental conditions and IP alarms. In addition, devices may be pinged over the telephone and power gate outlets switches.

The voice status report is customized based on a User's Code, wherein only callers with a valid User Code can hear a Status Report. Alternatively, the Host 10 is also capable of matching the calling number to one of the Contact Numbers, using Caller-ID (if available). When the unit receives Caller-ID information it searches all of the Contact Numbers to find a match to a particular user. When a match is found the unit customizes the report based on the User Profile, including what Classes a User has selected. Only inputs for which there is a Class match between the user Class List and the input Alarm Class will be reported. For example, if a user had selected temperature and humidity in their User Class List, then only inputs with Alarm Class temperature and humidity will be reported.

To receive a voice status report, a user calls the Host via a touch-tone phone. The Host (i.e., customized voice) will begin speaking and request a User Code. When the Host receives a valid User Code, it will continue with several menu options. A sample of the main menu is shown below:

"Hello, this is the XYZ HOST at the IT Dept of XYZ Company."

"Enter your user code:"

"To hear the environmental status, press 1."

"To hear the IP status, press 2."

"To ping an IP device, press 3."

"To check the status of a PowerGate outlet, press 4."

"To switch an outlet on a PowerGate, press 5."

"To turn on the microphone, press 6."

"To disconnect, press 7."

"To repeat this menu, press 8."

If the caller selects option 1, for example, they get a sub-menu asking if they would like to hear an environmental alarm summary report or a full environmental status report. The alarm summary only reports on inputs that are currently beyond their limits, or are in an alarm condition and have a class match. The full report provides status on all inputs that have a class match. A sample of a full environmental status report is listed below. Items in italics may be custom messages recorded by the user.

Channel 1, temperature in the server room, is 76.4 degrees Fahrenheit, OK

Channel 2, temperature in rack B, is 82.7 degrees Fahrenheit, too high

Channel 3, humidity in the server room, is 33.9%, OK

Channel 6, water under the server room floor, OK

Channel 7, smoke alarm in the server room, OK

Channel 9, battery, is 100.0%, OK

Channel 10, power, is 116.3 volts, OK

Channel 11, Sound level, OK

It is to be appreciated that the Voice menus are intelligent, such that they will only recite menu options if there is relevant content. For example, if there are no IP Alarms programmed then the IP Alarm menu option is skipped, or if there is no power control unit (i.e., PowerGate) connected, then this menu option will be skipped; or if the User has no Environmental sensors in his class, then these will be skipped.

When the voice message finishes speaking, it will request acknowledgment (if the call type is Until Acknowledged; if the call type is Inform, the unit will just speak the alarm message and disconnect). A sample Voice Alarm call is shown below:

"XYZ HOST Alarm Message, press any key to continue"

"XYZ HOST Alarm Message, press any key to continue" {call is answered and a 5 is pressed}

"XYZ HOST Alarm Message. The temperature is High at the IT Dept of XYZ Company."

"Channel 1, temperature in the server room, is 81.5 Degrees Fahrenheit"

"Level exceeded limit of 80 Degrees Fahrenheit at 7:45PM."

"Enter User Code:" {valid User Code is received}

"Alarm Acknowledged. Goodbye."

The Host allows for performance of an IP Ping during a voice call-in. After dialing the Host, press a touch-tone after the beep. The Host will request your User Code. Next, listen to the menu choices. Option 3 will allow you to enter an IP address in numeric dot-quad format. Use the * key for a dot. A sample IP Ping is shown below:

"Hello this is the Host XYZ at the IT Dept of XYZ Company."

"Enter your User Code:" {valid User Code is received}

"To hear the environmental status, press 1."

"To hear the IP status, press 2."

"To ping an IP device, press 3." {3 is received}

"Enter IP address, Use the star key for dot. Press pound (#) when finished."{user enters 10.1.4.17}

"Pinging now . . . "

"10.1.4.17 is not responding"

Thus, the foregoing discussion describes a device where a user makes a remote phone call to a Host, and through Touch Tone commands, requests the Host to perform a status. The results of the Status Inquiry are then provided by a digital voice output.

Turning to a further feature of the present application, it is possible to provide an e-mail setup with two-way e-mail commands. Particularly, the Host or Node sends alarm messages via e-mail as well as responds to commands via e-mail. To setup e-mail parameters, an "Internet Settings" entry is selected as shown in FIG. 6R wherein the e-mail Settings tab 390 is selected. To have the Host or Node unit send the e-mail the SMTP server name, a return e-mail address, User name, and password are entered.

For two-way e-mail commands a POP server name, e-mail account, User name, and password are entered, whereby the Host is assigned its own e-mail account, which it is constantly checking for incoming messages. By this design, the Host has the ability to send and receive POP/SMTP e-mail. In addition to using e-mail as a method of delivering outbound alarm messages, e-mail can therefore be used for remote access to the Host. Particularly, a message is sent to the Host e-mail account that contains command requests. The Host performs the request, and then e-mails a reply to the User. Thus, a set of commands are available that can be sent to a Host, within an e-mail, that causes the Host to reply back to the sending e-mail address. Using this feature, an e-mail can be sent to the Host that requests it to perform, for example, a TCT/IP network diagnostic command, and then e-mail the results. Illustrated below is a sampling of two-way e-mail commands which are available.

A status report request is made by sending an e-mail message to the Host with the following information:

To: <e-mail address of XYZ Host>

Subject: XYZ Host username: <valid profile username> email: <your e-mail address> command: status

An IP ping request to a monitored device is made by sending an e-mail message to XYZ Host with the following information:

To: <e-mail address of XYZ Host>

Subject: XYZ Host username: <valid profile username> email: <your e-mail address> command: ping xxx.xxx.xxx.xxx

An IP trace-route request is made by sending an e-mail message to XYZ Host with the following information:

To: <e-mail address of XYZ Host>

Subject: XYZ Host username: <valid profile username> email: <your e-mail address> command: traceroute xxx.xxx.xxx.xxx

An IP PowerGate Outlet command request is made by sending an e-mail message to XYZ Host with the following information:

To: <e-mail address of XYZ Host>

Subject: XYZ Host username: <valid profile username> email: <your e-mail address> command: powergate "<PowerGate Name>" "<Outlet Name>" on/off/cycle

An e-mail can be received with an attached picture from any camera configured in the Host. The picture will be captured when the Host receives the e-mail request. To receive a picture, an e-mail message is sent to the XYZ Host with the following information:

To: <e-mail address of XYZ Host>

Subject: XYZ Host username: <valid profile username> email: <your e-mail address> command: camera <camera name>

It is to be noted that two-way e-mail is dependent upon User permissions. This means that the User can only receive information on items for which they have permissions.

Turning to another aspect of the present application, the interface software is compatible with video cameras that permit live streaming video. Such cameras included an AXIS 2100 or AXIS 2400 network camera. The camera itself connects to the network via a RJ-45 jack and supports 10/100 Mbit networks. One camera may be associated with each Host or Node. The console software allows for easily viewing live video wherever the camera is installed.

The present design also produces a web page which includes the status of all environmental inputs and IP alarms, links to view logged data for each input and IP alarm, links to view historical alarm information for each input and IP alarm, the present state of all power outlets, and links to live images from cameras. The web page is enabled through the Local Configuration process via a Host serial port. Optionally, the web page can also be password protected.

With attention to remote web pages, the system sends a copy of its web page to another web server via FTP (File Transfer Protocol), so the web page can be viewed on another network. To configure the unit to a FTP web page, a selection of "Internet Settings" on the expanded menu tree is provided. This brings up the page "Internet Settings" as shown in FIG. 6S (this is the same screen as in FIG. 6R) however the web page delivery tab 400 is selected. By checking the enable FTP delivery box 402 and filling in the requested information, the FTP server will provide the information for the remote web page processing. A service provider will provide the FTP server name and subdirectory where the system files will be uploaded. To view the remote page that the system has uploaded, you will need to know its web address. This address corresponds to the server name, plus the directory, plus the file name of the web page.

The present embodiment of this system allows for the logging of up to 62,500 sample of environmental and IP alarm history. Environmental data will display the actual value and the IP alarm data will display either normal, timed out, or IP down. All stored history is performed at the same interval as programmed on the history programming screen. Each sample includes a time and date stamp. Data log history will be viewed and retrieved via the systems web page by clicking on the input value (for environmental inputs) or the status for IP alarms.

The invention has been described with reference to the preferred embodiments. Obviously, modifications and alteration will occur to others upon reading and understanding the preceding detailed description. It is intended that the invention be construed as including all such modification and alterations insofar as they come within the scope of the appended claims or the equivalence thereof.

Having thus described the preferred embodiments, the invention is now claimed to be:

1. A method of performing monitoring of a standalone monitoring system comprising:

inputting analog signals from external sensors to sensor inputs of a host, wherein the external sensors monitor a plurality of conditions in a server room holding at least one server, the conditions being monitored including at least a sub-group including temperature, temperature of a server rack, humidity, under the server room floor, smoke, power values, battery levels and sound levels, in the server room;

converting the analog signals received at the sensor inputs to digital signals;

scanning the digital signals, by a processing system, wherein current values of the conditions being monitored by the external sensors are obtained by the processing system;

determining whether any of the values from the external sensors are beyond a preset range;

generating an alarm signal for the at least one external sensor when at least one of the values is beyond the preset range;

generating a status report for the at least one external sensor when at least one of the values is within the preset range;

dispatching the alarm signals or the status report simultaneously via at least one of a phone path leading to a public phone network and a network path leading to at least one of a TCP/IP network or private LAN or WAN data network;

the phone path configured by operatively connecting the processing system, an integrated voice/data modem, and a phone network connector, wherein alarm signals and status reports are delivered to an external source as a voice call message; and the network path configured by operatively connecting the processing system and a network connector, wherein alarm signals and status reports are delivered to an external source as at least one of an e-mail message, a message to a web page or an SNMP trap message.

2. The method according to claim 1, further including:

configuring the host to be contacted via a touch tone phone;

generating, by the host, a voice command menu, which provides a plurality of command options;

designing the host to receive selected commands from the voice command menu dependent on commands selected by use of the touch tone phone;

performing, by the host unit, the commands entered via the touch tone phone; and outputting, as a voice call status report, the results of the performed commands.

3. The method of claim 2 wherein the voice command menu is customized.

4. The method of claim 2 wherein the voice call status report is customized.

5. The method of claim 2 wherein the status report is provided only to a user with appropriate permissions.

6. The method according to claim 1, further including:

assigning an e-mail account to the host;

checking, by the host, the e-mail account for incoming messages;

configuring the host to receive in its e-mail account an e-mail including a command request;

performing, by the host, operations associated with the command request received in the host e-mail account;

generating an e-mail, by the host, with a status report of the performed command request; and sending the e-mail outside of the host to an external location, wherein the sending provides a two-way e-mail communication.

7. The method according to claim 6, wherein the two-way e-mail is dependent upon a user's permissions.

8. The method according to claim 6, wherein the e-mail sent by the system in the two-way e-mail process, includes an electronic image.

9. The method according to claim 1, wherein the external source is a person, and the plurality of conditions in the server room are defined as classes.

10. The method according to claim 9, wherein the user selects the classes for which they have responsibility.

11. The method according to claim 10, further including generating a class table, wherein classes are generated.

12. The method according to claim 1, wherein the user is one of a Master System Administrator, Site Administrator or User.

13. A monitoring system designed to monitor a plurality of conditions in server room and to generate voice alarms and voice status reports, the system comprising:

a host including a plurality of sensor inputs to which are connected at least some sensors monitoring the plurality of conditions, including temperature, temperature of a server rack, humidity, water under the server room, smoke, power values, battery levels and sound levels, in the server room;

a converter designed to receive signals from the sensor inputs and to convert the signals into digital signals;

a processing system configured to receive the digital signals and to generate voice alarm signals or voice status reports in response to selected ones of the received digital signals;

an internally integrated voice and data modem in operative association with the processing system to receive data in the form of the voice alarm signals or voice status reports;

a phone connector in operative association with the voice/data modem, to act as a port for transmission of the voice alarm signals or voice status reports to an external telephone network; and a network connector in operative association with the processing system to receive data, in the form of alarm signals or status reports, from the processing system and to act as a port for transmission of the voice alarm signals and voice status reports to an external data network, wherein the same voice alarm signals or voice status reports may be provided via both the phone connector and network connector.

14. The system according to claim 13, wherein the voice status reports are generated in response to an inquiry from a user, and each voice status report includes an intelligent voice menu reporting the status of alarm conditions, wherein the intelligent voice menu issues voice alarm signals when relevant content exists.

15. The system according to claim 13, wherein the voice alarm signal includes codes which cause a call to a main telephone number, a time delay and a call to an extension number.

16. The system according to claim 13, further including a microphone arrangement connected to detect sound level alarms, and a filter to filter sounds detected by the microphone arrangement, wherein only sounds related to the sound level alarms are detected.

* * * * *